US007014289B1

(12) United States Patent
Matsuda

(10) Patent No.: US 7,014,289 B1
(45) Date of Patent: Mar. 21, 2006

(54) IMAGE FORMING DEVICE

(75) Inventor: Yuji Matsuda, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 09/937,858

(22) PCT Filed: Apr. 24, 2000

(86) PCT No.: PCT/JP00/02670

§ 371 (c)(1),
(2), (4) Date: Sep. 28, 2001

(87) PCT Pub. No.: WO00/64677

PCT Pub. Date: Nov. 2, 2000

(30) Foreign Application Priority Data

Apr. 22, 1999 (JP) ..... 11/114534

(51) Int. Cl.
*B41J 29/393* (2006.01)
*B41J 23/00* (2006.01)

(52) U.S. Cl. ..... 347/19; 347/37

(58) Field of Classification Search ..... 347/16, 347/19, 37, 41; 400/74
See application file for complete search history.

(56) References Cited

U.S. PATENT DOCUMENTS

| | | | | |
|---|---|---|---|---|
| 4,675,696 A | | 6/1987 | Suzuki | 347/19 |
| 5,170,416 A | * | 12/1992 | Goetz et al. | 377/17 |
| 5,451,990 A | | 9/1995 | Sorenson et al. | 347/37 |
| 5,600,350 A | * | 2/1997 | Cobbs et al. | 347/19 |
| 5,926,192 A | * | 7/1999 | Yamane | 347/10 |
| 6,082,911 A | * | 7/2000 | Murakami | 400/74 |
| 6,354,691 B1 | * | 3/2002 | Uchikata | 347/37 |
| 6,367,903 B1 | * | 4/2002 | Gast et al. | 347/9 |
| 6,390,588 B1 | * | 5/2002 | Ikeda | 347/19 |
| 6,409,301 B1 | * | 6/2002 | Takata et al. | 347/19 |

FOREIGN PATENT DOCUMENTS

| | | |
|---|---|---|
| EP | 0 540 244 A3 | 5/1993 |
| EP | 0 540 244 B1 | 5/1993 |
| EP | 0 622 236 A3 | 11/1994 |
| EP | 0 622 236 B1 | 11/1994 |
| EP | 0 858 897 A1 | 8/1998 |
| EP | 0 867 298 A2 | 9/1998 |
| JP | 7-323582 | 12/1995 |
| JP | 2000-94718 | 4/2000 |

* cited by examiner

*Primary Examiner*—Thinh Nguyen
(74) *Attorney, Agent, or Firm*—Dellett & Walters

(57) ABSTRACT

A head (101) prints a predetermined test pattern under the control of a head control unit (204) in order to precisely detect a head deviation when a head has been changed, the printed test pattern is read by a sensor 110 and detected by a pattern detector (209). Every time an interrupt signal corresponding to the edge of a detected pattern element is input to the CPU (203), a value of a main scanning counter (205)/main scanning timer (207) (and/or a sub-scanning counter (206)/sub-scanning timer (208)) is read, the printing position of each pattern element is detected from the value, and the mounting deviation of the head is calculated based on the detection result of the printing position of each pattern element printed by the head. The vertical bar of a test pattern may be printed in multiple passes. A plurality of edges may be detected at different longitudinal positions of the bar and the detected results are averaged to determine an edge position.

17 Claims, 22 Drawing Sheets

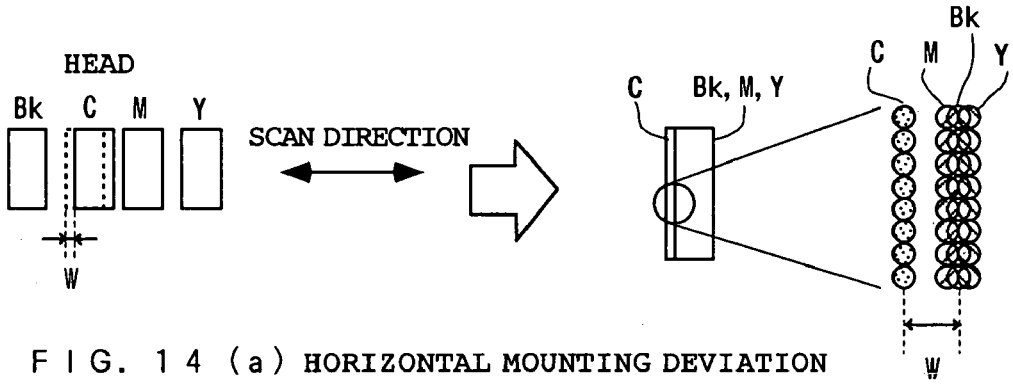
FIG. 14 (a) HORIZONTAL MOUNTING DEVIATION
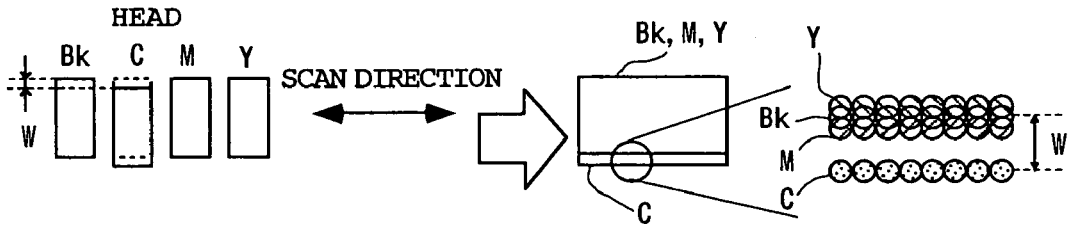
FIG. 14 (b) VERTICAL MOUNTING DEVIATION
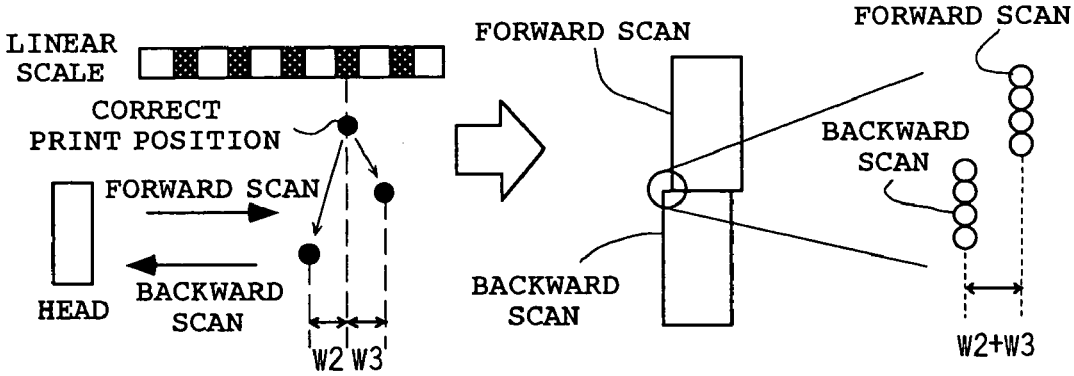
FIG. 14 (c) FORWARD/BACKWARD PRINT DEVIATION

IMAGE FORMING DEVICE

TECHNICAL FIELD

The present invention relates to an image forming device that forms an image with the ink jet recording method.

BACKGROUND ART

In the ink jet recording method, pulse signals are applied to a heater disposed in an ink-filled nozzle to heat the heater, to boil ink, and to cause the boiled ink to increase the vapor pressure to jet ink. To use this method on an image forming device, a plurality of nozzles are arranged to form one recording head, and a plurality of recording heads (for example, for jetting ink in cyan, magenta, yellow, black, and so on) are combined, to form a full-color image.

Conventionally, when forming an image using a plurality of recording heads by the ink jet recording method, the problem is that a horizontal deviation between any two recording heads, as shown in FIG. 14(*a*), is sometimes introduced when the recording heads are mounted on a carriage at a factory at shipment time or when a service engineer or a user replaces one or more recording heads. (In the example shown in the figure, the recording head of cyan (C) is deviated from the correct position by W). This deviation sometimes generates vertical stripes at print time and results in an unevenly printed image. Similarly, a vertical deviation between any two recording heads introduced when the heads are mounted, as shown in FIG. 14(*b*), sometimes generates horizontal stripes and results in an unevenly printed image.

In addition, on a device that uses a linear scale for establishing ink jet synchronization to jet ink at correct positions in the main scanning direction of the recording head, a jet position deviation (W2+W3) may occur during forward and backward printing depending upon the movement speed of the carriage, sometimes resulting in an uneven image printing. This deviation is caused by a delay generated before the ink is jetted from the time of passing the slit position as shown in FIG. 14(*c*).

Therefore, when a color registration error (hereinafter called a registration deviation) occurs through the recording head replacement or for some other reasons, the individual recording heads must be registered (i.e. registration adjustment). A registration deviation amount must be detected before making the registration adjustment. There are two methods of detecting registration deviation amounts: one is to print a particular test pattern, designed to make a registration deviation readily detectable, on paper so that human beings can check the print result to manually detect a registration amount, and the other is to cause a sensor to read a test pattern to detect a registration deviation.

The technology for reading the test pattern via a sensor is disclosed in Japanese Patent Laid-Open Publication No. Hei 7-323582. As shown in FIG. 15, the base recording head, one of a plurality of recording heads, and each of the other recording heads print a pattern made up of two parallel bars (pattern elements) to allow the sensor to read the same position of the parallel bars twice to detect the recording head deviation amount. That is, in the first scan, the sensor senses the width of each pattern element to calculate the center dot position thereof. Then, in the second scan, the sensor senses the width W1 between the pattern elements of the base head, based on the center dot positions of the pattern elements. Repeating the above-described operation for the pattern element of the base head and those of the other heads to calculate the widths (distances) W2, . . . , between the pattern elements of the base head and those of the other heads. Then, the head deviation amount ΔW is calculated based on the difference of those widths.

To do so, a comparator 1502 converts the analog signal, which is output from a sensor 1501, into a binary (bi-level) signal as shown in FIG. 16. In the first scan, this binary signal is sampled in a predetermined timing in accordance with a timer 1503. Each time a pattern element is read, a CPU 1505 references the value of the timer 1503 to read the pattern width data of each of two pattern elements. After the scan is terminated, the distance from the edge of the pattern element to the center dot is calculated from the scan speed and the sampling frequency, based on the width data of each of two pattern elements. After that, setting the center value of each pattern element in the timer 1503 immediately before the pattern is read in the second scan causes the timer 1503 to output a carry signal at the time the carriage reaches the center position of the pattern element. By operating a timer 1504 using this carry signal, the distance between the center dot position of a pattern element and that of another pattern element is calculated. This is done for the pattern elements of the base head and for the pattern elements of the base head and other heads to calculate the head deviation amount ΔW.

However, in this case, the signal is sampled in a predetermined timing. Therefore, the carriage speed varies during carriage scanning, from scan to scan, or from device to device due to various mechanical factors such as the tension of a drive belt connecting the carriage and the motor. This variation is accumulated in the sampling results, sometimes affecting the precision of registration adjustment. In addition, detecting each pattern-to-pattern width W1, W2, . . . requires the carriage to scan twice, thus requiring a long detection time and, at the same time, doubling the accumulation variation.

This applies also to the paper conveyance direction. Variations in the paper conveyance roller diameter, eccentricity, and gears connecting the motor to the roller generate accumulation variations in the accumulated sampling results.

In view of the foregoing, it is an object of the present invention to provide an image forming device capable of precisely detecting a recording head deviation when the recording head has been replaced.

In addition, variations in the shape or the direction of nozzles, introduced when manufacturing the recording head, will cause ink droplets to be jetted, not in exactly correct positions in a straight row as shown in FIG. 23(*a*), but in positions shifted vertically and/or horizontally as shown in FIGS. 23(*b*)–23(*d*). In the method described above in which a test pattern is read by the sensor to detect a registration deviation amount, two parallel pattern elements are printed by the base head and each of other heads. Then, the sensor reads the width of each pattern element from the edges of the pattern as well as the distance between the centers of the pattern elements of the base head and each of the other heads. Therefore, variations in the edges of pattern elements are generated as described above, and those variations generate read errors.

Also, when mounting a recording head 101 on a carriage 106, mechanical variations in the recording head 101 and the carriage 106 may cause the recording head 101 to be inclined with respect to the main scanning direction as shown in FIG. 24. In addition, the position at which a sensor 110 is mounted on the carriage 106 may vary according to the device. The recording head 101, if inclined with respect to the carriage 106, causes the pattern elements to be inclined as shown in FIGS. 25(*b*) and 25(*c*) although those pattern elements should be vertical bars (FIG. 25(*a*)). On the other hand, if the sensor read positions in the longitudinal direction of the pattern element vary as indicated by A to D, detection errors up to the value d occur.

As described above, there is a possibility in the conventional registration detection method that the pattern detection result varies greatly according to the manufacturing variations in the recording head 101, how the recording head 101 is mounted on the carriage 106, and how the sensor 110 is mounted.

Therefore, it is another object of the present invention to provide an image forming device capable of detecting a test pattern more precisely in order to precisely detect a head deviation when a recording head has been replaced.

DISCLOSURE OF INVENTION

An image forming device according to the present invention forms an image on a print paper in an ink jet recording method with a plurality of heads. The device comprises main scanning direction moving means for moving a carriage in a main scanning direction, the carriage having the plurality of heads mounted thereon; paper conveying means for conveying the print paper in a sub-scanning direction; pattern printing means for printing, with at least one head, a test pattern including predetermined pattern elements; pattern detecting means, mounted on the carriage, for detecting the pattern elements of the test pattern printed on the print paper by the printing means; binary conversion means for binarizing an output of the pattern detecting means; position detecting means for detecting a position of the carriage in the main scanning direction; and calculating means for moving the carriage to detect the pattern elements of the test pattern with the pattern detecting means, for detecting a print position of the pattern elements based on a detection result of the position detecting means when a rising and/or falling edge of a binary signal obtained by the binary conversion means is generated, and for calculating a mounting deviation amount of each head in the major scanning direction, wherein the position detecting means comprises low-resolution position detecting means based on a linear scale provided on a movement path of the carriage and high-resolution position detecting means for detecting a position more finely than a minimum unit determined by a resolution of the low-resolution position detecting means. In this way, the device according to the present invention detects the position of the carriage at a time of a change in the output from the pattern detecting means, allowing the position of the pattern element to be detected precisely without being affected by the carriage speed variations generated by mechanical causes. In addition, the mounting error of each head may be obtained by finding the position of the pattern element in one single scan and by comparing it with the indicated print position of the pattern. Combining the low-resolution position detecting means with the high-resolution position detecting means makes it possible to detect the position of the pattern element more precisely.

The test pattern is, for example, at least one vertical bar extending in the sub-scanning direction almost perpendicular to the main scanning direction.

The test pattern may include, for each head and as a pattern element, at least one horizontal bar extending almost in parallel with the main scanning direction. In this case, the device further comprises conveyance amount detecting means for detecting a conveyance amount of the print paper in the sub-scanning direction almost perpendicular to the main scanning direction; and measuring means for measuring the conveyance amount equal to or smaller than the unit of the timer of the conveyance amount detecting means. The calculating means moves the print paper, on which the test pattern is printed, with the use of the paper conveying means with respect to the carriage to detect the pattern elements of the test pattern with the pattern detecting means, detects the print position of the pattern elements based on the detection results of the conveyance amount detecting means and the measuring means when a rising and/or falling edge of the binary signal obtained by the binary conversion means is generated, and calculates an amount of mounting deviation of each head in the sub-scanning direction based on the print position of the pattern elements printed by each head.

The pattern detecting means is a reflective sensor comprising a light emitting element and a light receiving element.

The low-resolution position detecting means comprises, for example, a counter for counting a timing signal based on the linear scale, and the high-resolution position detecting means comprises a timer which is initialized by the timing signal and measures a time with a predetermined clock signal.

The pattern printing means may cause each of different portions of a single head to print a plurality of dots sequentially in a plurality of passes, the plurality of dots constituting a portion of the vertical bar. This method, what we call multi-pass recording, reduces horizontal positional deviations at upper and lower portions of the vertical bar caused by head skews or variations in head recording elements.

The calculating means uses the pattern detecting means to detect the vertical bar at least two positions in a longitudinal direction of the vertical bar to obtain a print position of the vertical bar based on an average value of the detected results. This processing averages pattern position detection errors.

In addition, the device may further comprise means for measuring a unit time interval of the linear scale at a time the pattern elements are detected; and means for correcting a measured value of the timer based on the measured value and a theoretical value of the unit time interval. This configuration eliminates the effect of carriage speed variations when detecting the position within the unit time interval.

Preferably, the calculating means calculates the center position of the width of the pattern element based on both edges of the obtained pattern element. This method eliminates the dependency of the position detection result upon the paper types and paper floating.

A method according to the present invention, for use on an image forming device with a linear scale provided on a carriage movement path, for detecting a deviation between a print position actually printed on a print paper by a head and a print target position comprises the steps of providing a timer for detecting a position within a unit interval determined by a resolution of the linear scale; printing a predetermined print element at the target position on the print paper by the head mounted on a carriage that scans in a major scanning direction; detecting the print element with a sensor mounted on the carriage; and detecting a low-resolution position based on the linear scale when the print element is detected and, detecting a high-resolution position within the unit interval with the timer, and obtaining the deviation between the detected position and the print target position.

BRIEF DESCRIPTION OF DRAWINGS

FIGS. 14(*a*), 14(*b*), and 14(*c*) are diagrams showing print results when a head is deviated in position;

BEST MODE FOR CARRYING OUT THE INVENTION

Some embodiments of the present invention will be described more in detail with reference to the drawings.

Figure 1:
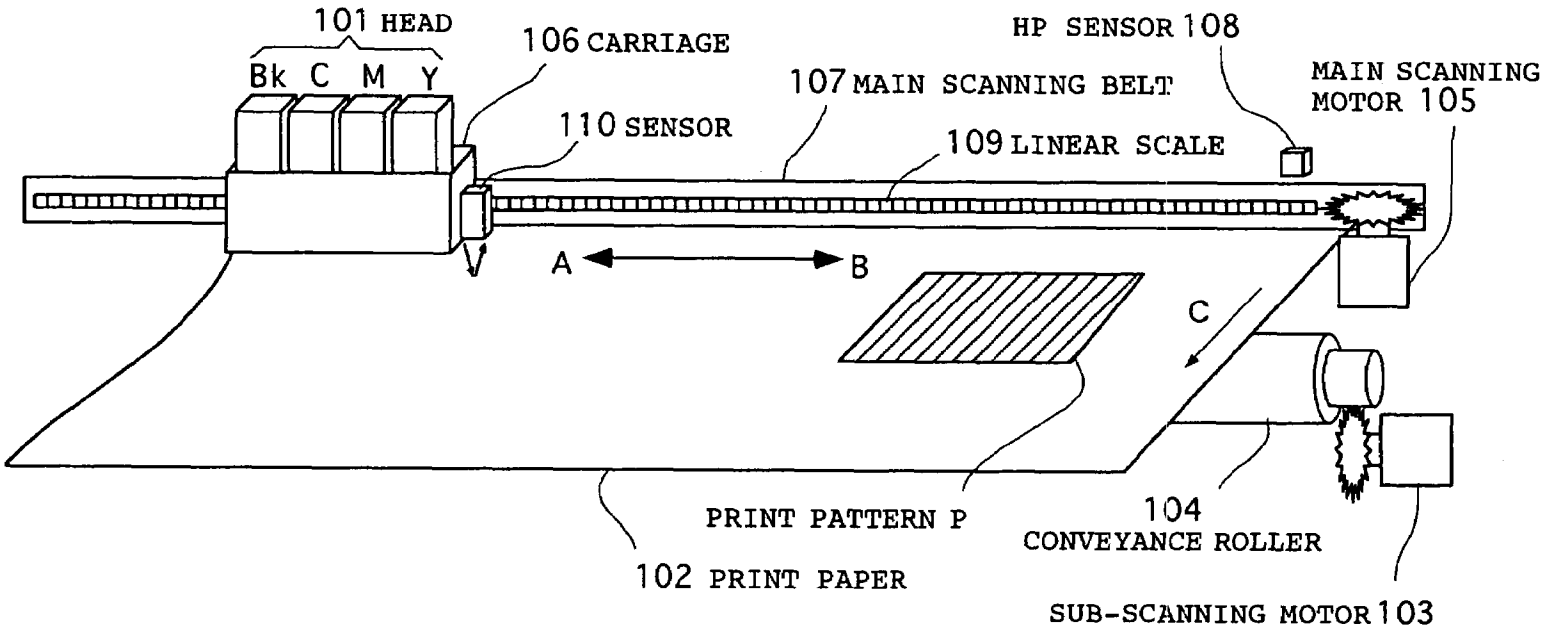
FIG. 1 is a diagram showing the main unit of an image forming device in an embodiment of the present invention.

FIG. 1 is a diagram showing the general configuration of an ink jet image forming device in the form of a serial printer according to the present invention. Black, yellow, magenta, and cyan ink are supplied from the ink tanks to recording heads 101Bk, 101Y, 101M, and 101C each via an ink tube (both not shown). A recording head 101 is driven by a recording head driver or the like in response to the recording signal corresponding to recording information from a main controller (not shown). This causes ink droplets to be jetted from the recording head 101 onto a print paper 102 for color recording.

A sub-scanning motor (a paper conveyance motor) 103, which is a driving source for intermittently feeding the print paper 102, drives a conveyance roller 104 via gears. A main scanning motor 105 is a driving source that causes a carriage 106, with the recording head 101 thereon, to scan in the directions indicated by arrows A and B via a main scanning belt 107.

When the print paper 102 that is fed and conveyed by the conveyance roller 104 reaches a print position, the paper conveyance motor 103 is turned off to stop the conveyance of the print paper 102. Before starting image recording on the print paper 102, the carriage 106 moves to the position of a home position (HP) sensor 108. Then, the carriage scans forward in the direction indicated by arrow A, and jets black, yellow, magenta, and cyan ink from the recording heads 101Bk–101C at predetermined positions to record an image. After recording a specified width (called a band) of an image during one scan operation by the carriage 106, the carriage 106 stops and then starts backward scanning in the direction indicated by arrow B to return to the position of the home position sensor 108. During backward scanning, the paper conveyance motor 103 is driven to convey the print paper 102 by the amount of one band, which was recorded by the heads recording 101Bk–101C, in the direction indicated by arrow C. Repeating the scanning operation of the carriage 106 (and head 101) and the paper feed operation in this way records an entire image.

Figure 12:
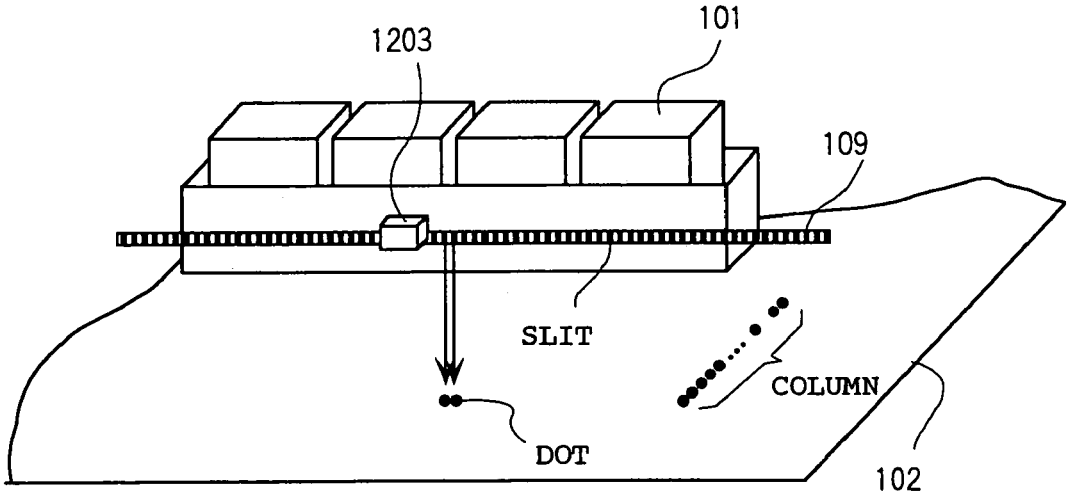
FIG. 12 is a diagram showing the configuration of a linear scale and a print timing in the embodiment of the present invention.

A linear scale 109 provided next to, and parallel with, the scanning path of the carriage 106 has slits provided therealong at a predetermined resolution (resolution). A transmission type optical sensor (1203 in FIG. 12) installed near the carriage 106 reads the slits on the linear scale 109 to obtain two signals each with its own phase (90° out of phase). These signals are used to manage the position of the carriage 106 and, at the same time, synchronize the ink jet from the recording head 101.

In this embodiment, a recording head with the resolution of 600 dots/inch and a linear scale with the resolution of 600 dots/inch are used to allow an image to be printed at 600 dots/inch.

Also provided near the carriage 106 in this embodiment is a reflective type optical sensor 110. When any of the recording heads 101 on the carriage 106 cannot form a good image because any of plural recording elements are damaged or ink is not jetted from those elements, the recording head must be replaced. When some of a plurality of recording heads or all of them have been replaced or when the positional relationship among the plurality of recording heads is not correct for some reasons, the images, each formed in a color, are not registered correctly. This is a serious problem because a good image cannot be obtained. Therefore, when a color deviation (registration deviation) occurs at head replacement time or for some reasons, the positions of the recording heads must be corrected for registration adjustment. To do so, a particular test pattern (print pattern) P is printed to allow the sensor 110 to read it for detecting a registration deviation amount. And, based on the detected registration deviation amount, the registration adjustment is made. The present invention is characterized most in the detection of this registration deviation amount, which will be detailed below.

Figure 2:
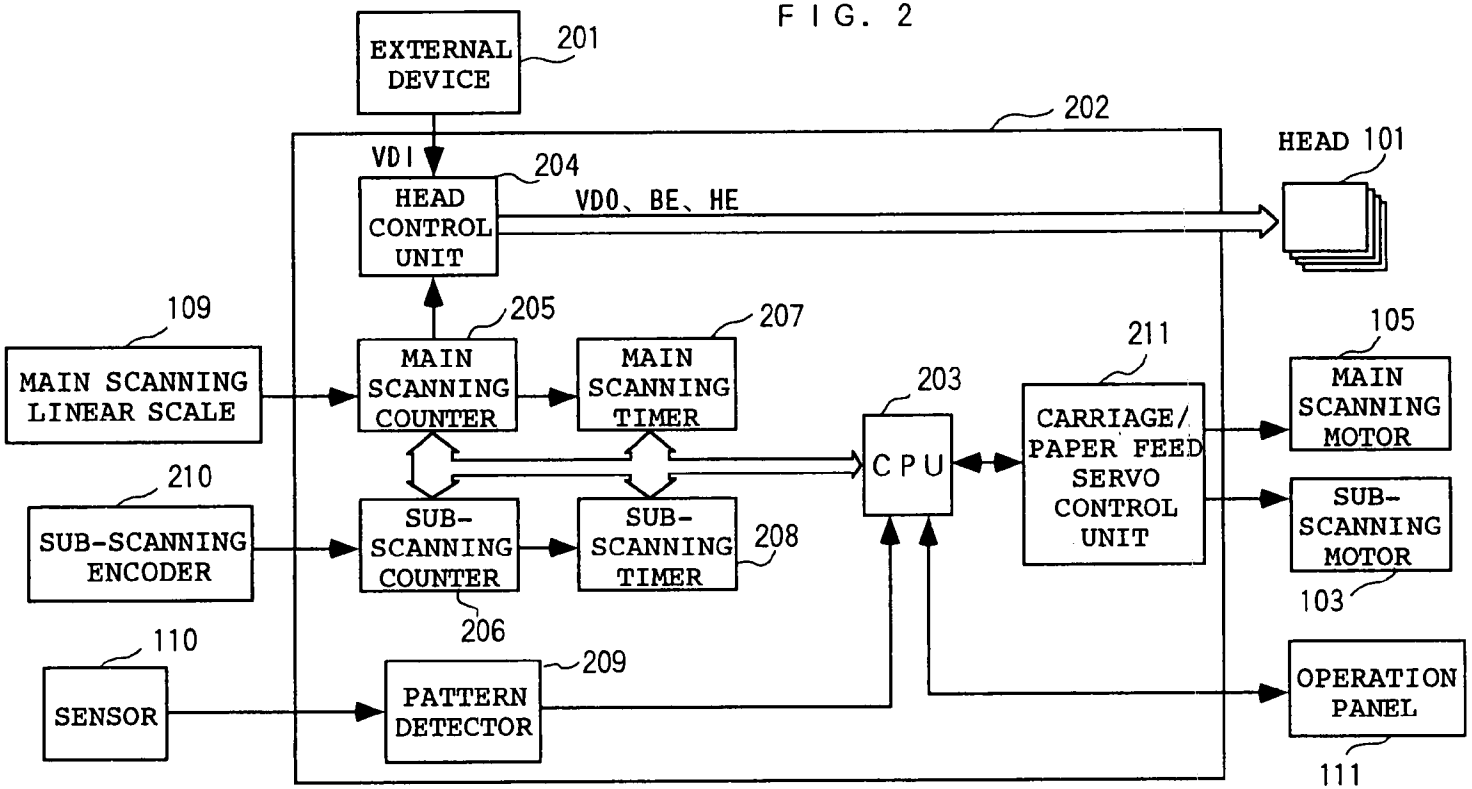
FIG. 2 is a diagram showing the control block in the embodiment of the present invention.

FIG. 2 is a block diagram showing the configuration of the control hardware of an image forming device in a first embodiment of the present invention. The image forming device shown in the figure, which comprises a print control unit 202 and the heads 101, is connected to an external device 201. The external device 201—a computer, an image reader, and some other device—is a host unit which provide the image forming device with image data or commands required for recording.

Connected to the print control unit 202 are the main scanning linear scale 109, a sub-scanning encoder 210, the main scanning motor 105, sub-scanning motor 103, sensor 110, and an operation panel 111.

The print control unit 202 receives image data VDI from the external device 201 and controls the formation of an image on the print paper with the use of the heads 101. The print control unit 202 comprises a CPU 203, a head control unit 204, a main scanning counter 205, a sub-scanning counter 206, a main scanning timer 207, a sub-scanning timer 208, a pattern detector 209, and a carriage/paper feed servo control unit 211. The CPU 203 provides an interface with the external device 201 from which the serial image data VDI is transferred and, at the same time, controls the entire operation of the print control unit 202 including the memory and I/O devices.

More specifically, upon receiving the serial image data VDI from the external device 201, the CPU 203 issues a command to the head control unit 204 to temporarily store several bands of image data VDI into the image memory. Image processing is performed for the stored image data VDI, and image data VDO is output as the heads 101 scan. At this time, when controlling the image memory (not shown), the CPU 203 may variably set the horizontal and vertical addresses from which data is to be read. This operation makes it possible to correct the head mounting positions by varying a position from which the image data VDO to be printed by each head is read.

In this embodiment, the main scanning linear scale 109 and the sub-scanning encoder 210 are provided as shown in the figure. Two phase signals are output, each at the absolute position according to the movement amount; that is, when the main scanning linear scale 109 drives the carriage 106 with the main scanning motor 105 and when the sub-scanning encoder 210 feeds paper with the sub-scanning motor 103. The output from the main scanning linear scale 109 is used also as the print control synchronizing signal for outputting the image data VDO and, in synchronization with this signal, the image memory address signal is generated. Therefore, by changing an image memory address from which data is to be read, the registration deviation amount may be corrected on a linear scale basis in the main scanning direction, and on a head nozzle basis in the sub-scanning direction. Although not shown in the figure, the output of image memory data is delayed for the period of time that is set by the CPU 203 in synchronization with the synchronizing signal sent from the main scanning counter 205. This delay corrects a deviation less than the minimum interval detectable by the main scanning linear scale 109.

Figure 11:
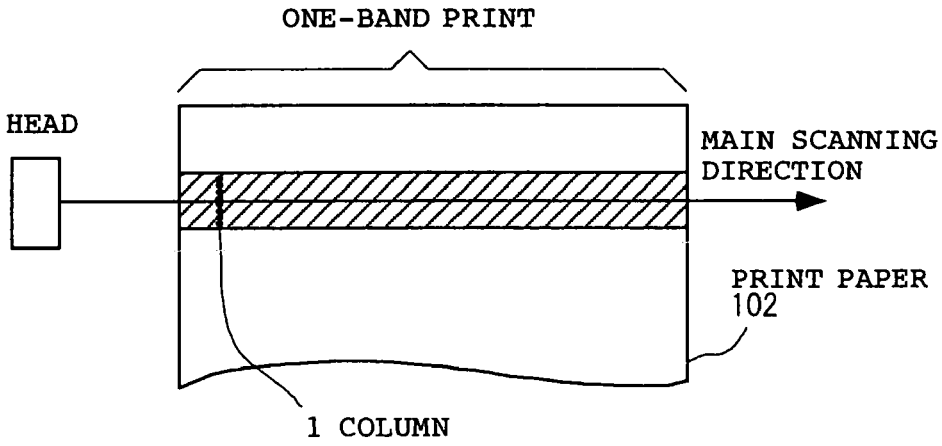
FIG. 11 is a diagram showing an image formation procedure in the embodiment of the present invention.

The head control unit 204 also generates signals, such as a head block enable signal BE and a heater drive pulse signal HE, necessary for jetting ink. The image data VDO, block enable signal BE, and heater drive pulse signal HE, which are output from the head control unit 204, are transferred to the head 101. In the control circuit in the head 101, only the heaters of the nozzles whose image data VDO and enable signals (indicated by BE and HE) are enabled are turned on. Ink is jetted from those nozzles onto a print paper to form one column of an image as shown in FIG. 11. Repeating this operation by causing the head 101 to scan in the main scanning direction forms a one-band image. Then, the print paper advances a specified amount to form another one-band image. Repeating this control forms the entire image on the print paper.

The carriage/paper feed servo control unit 211 receives the output from the main scanning linear scale 109 and the sub-scanning encoder 210 to feedback-control the drive speed, start, stop, and movement amount of the main scanning motor 105 and the sub-scanning motor 103 for positioning management.

The operation panel 111 is used by the user to issue operation instructions to the image forming device, including instructions for the print mode, demonstration printing, recording head recovery operation and so on. Instructions in the cases of head replacement and registration deviation correction may also be issued from the operation panel 111.

Figure 10:
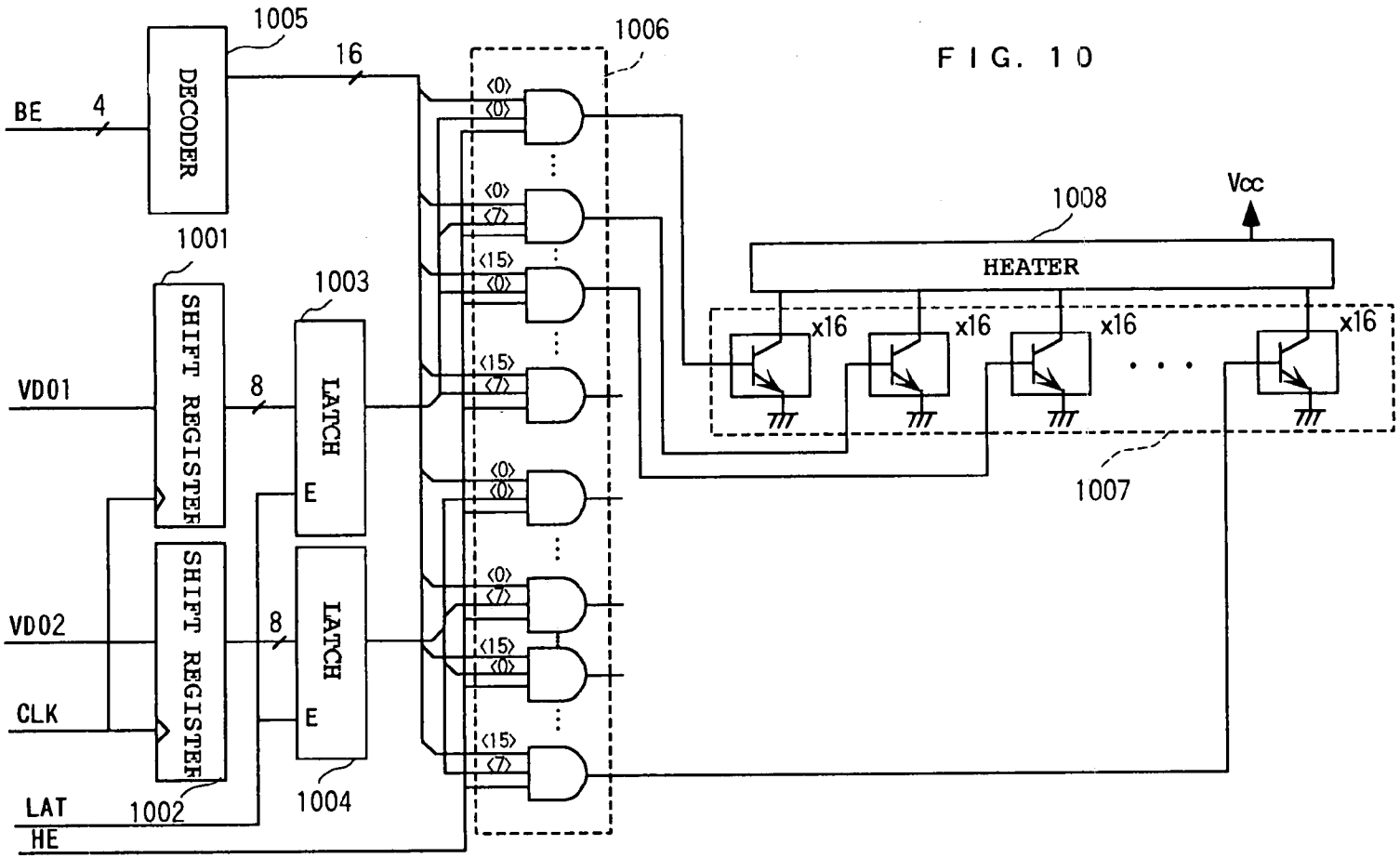
FIG. 10 is a diagram showing the internal circuit of a recording head in the embodiment of the present invention.

FIG. 10 shows the internal configuration of the head 101. Note that the figure shows the configuration of only one head. In FIG. 10, numerals 1001 and 1002 are shift registers, numerals 1003 and 1004 are latch circuits, numeral 1005 is a decoder circuit, and numeral 1006 is an AND circuit. Numeral 1007 is a transistor, and numeral 1008 is a heater.

Image data VDO1 and VD02 are serial binary data sent from the external device 201 in synchronization with the transfer clock CLK. This serial binary data is sequentially converted from serial to parallel by the shift registers 1001 and 1002. For each of video data VD01 and VD02, eight units of data are transferred and then latched by the LAT signal. In addition, a head composed of a plurality of nozzles is divided into n blocks (in this example, a 256-nozzle head is divided into 16 blocks), and the enable signal BE0–15 and the heater drive pulse signal HE are supplied, one pulse for each block. The transistor 1007 may be turned on only for the nozzles for which image data is enabled and, when the transistor is turned on, the corresponding heater 1008 is heated for jetting ink.

In the image forming device, the decoder 1005 binarizes the enable signal BE from 4 bits to 16 bits. From each nozzle, ink is jetted when the enable signal BE, the bits from the video data VDO1 and VD02, and heater drive pulse signal HE are all turned on.

Figure 3:
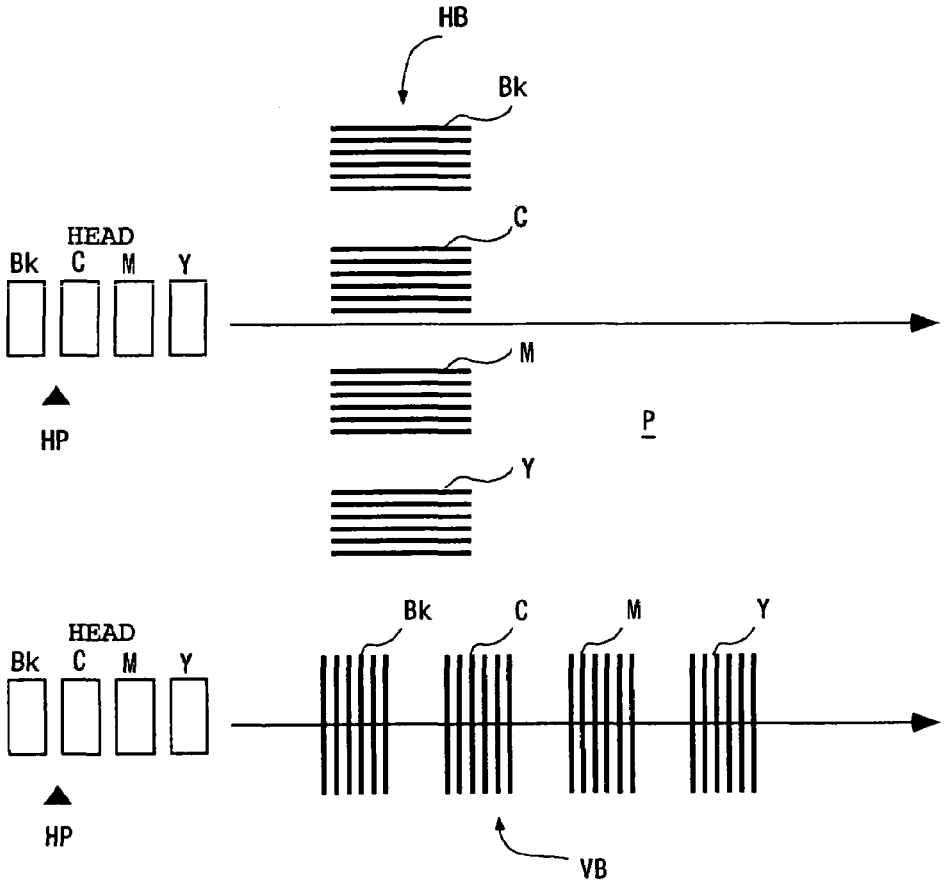
FIG. 3 is a diagram showing a test pattern (print pattern) used in the embodiment of the present invention.
Figure 13:
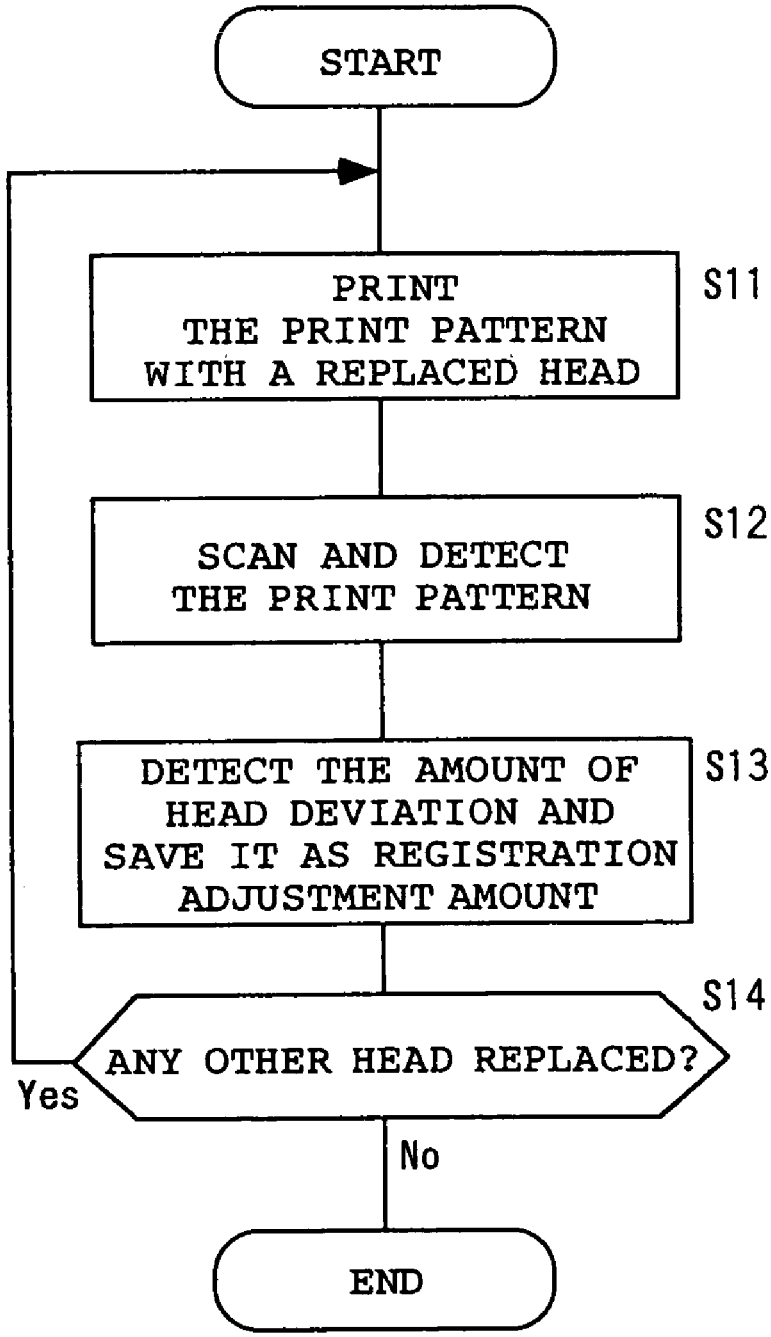
FIG. 13 is a flowchart showing an example of registration adjustment after a head is replaced in the embodiment of the present invention.
Figure 15:
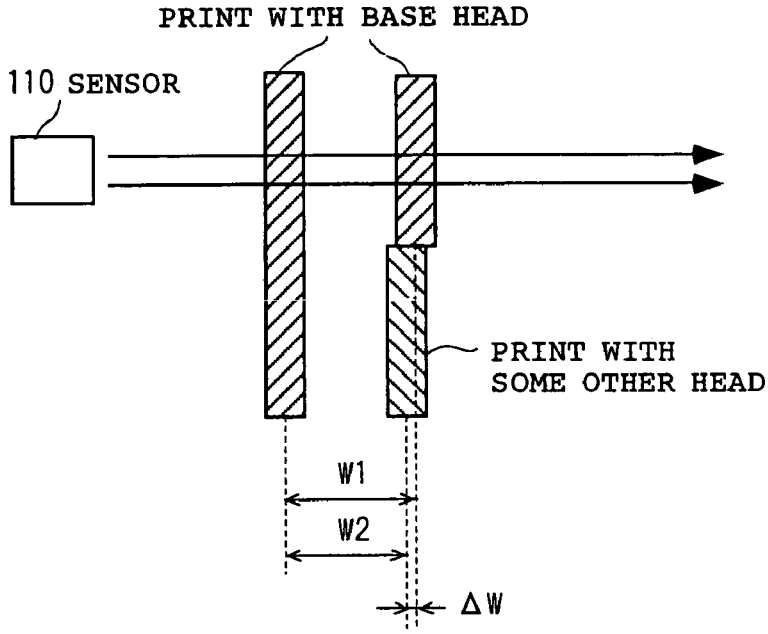
FIG. 15 is a diagram showing a print pattern used to detect a registration deviation in a conventional method.
Figure 16:
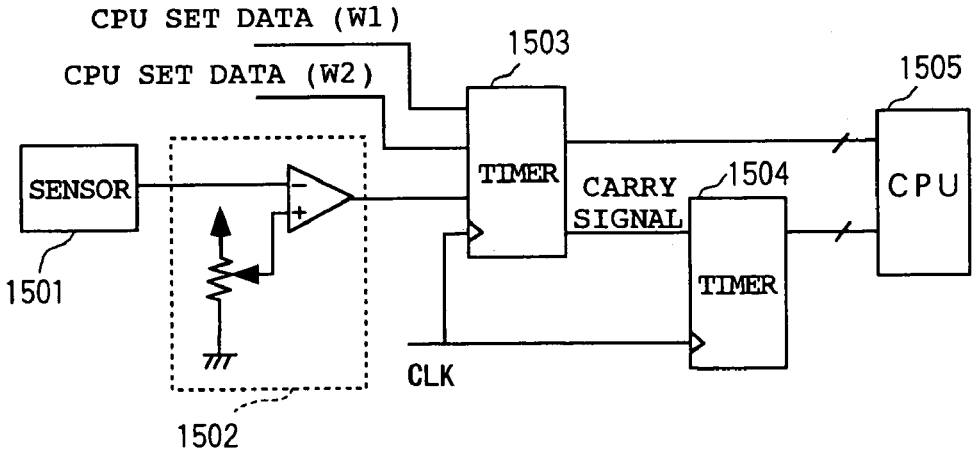
FIG. 16 is a diagram showing a control circuit used to detect a pattern in the conventional method.

FIG. 13 shows an example of registration adjustment that is made when a registration deviation correction instruction is issued in this embodiment. In most cases, this processing is performed immediately after head replacement. As shown in FIG. 3, each head is used to print the test pattern P composed of horizontal bars HB and vertical bars VB (S11). In FIG. 3, the horizontal bars HB are pattern elements used to detect a vertical registration deviation amount, while the vertical bars VB are pattern elements used to detect a horizontal registration deviation amount. In FIG. 3, only four blocks of pattern elements of the test pattern p for detecting a registration deviation amount, which are printed when the carriage scans in the forward direction, are shown. If there is a difference in the registration deviation amount in the forward direction and that in the backward direction, the pattern elements for use in the backward direction should be provided. Although, in the figure, a plurality of bars are printed at an equal interval in the pattern element block for each color, the bars need not be at an equal interval. This is because, when calculating a registration deviation amount, the deviation amount is calculated by comparing the indicated print position with the actual detection point. In addition, although the print patterns of all heads are shown as the test patterns in FIG. 3, the test patterns of all heads need not always be printed. For example, the print patterns printed only by the replaced head may be used. Although six pattern elements are shown for each head in the example of the figure, these elements are used only to calculate the average of a plurality of results. In principle, one pattern element is required for each head.

As described above, the sensor 110 is provided near the head (FIG. 1). After the test pattern shown in FIG. 3 is printed, the sensor 110 reads each pattern element (S12 in FIG. 3) to detect the deviation amount of the head and to save it as the registration adjustment amount (S13). These steps, S11–S13, may be performed separately for horizontal bars and vertical bars. These steps may also be repeated for each of the replaced heads (S14).

Figure 6:
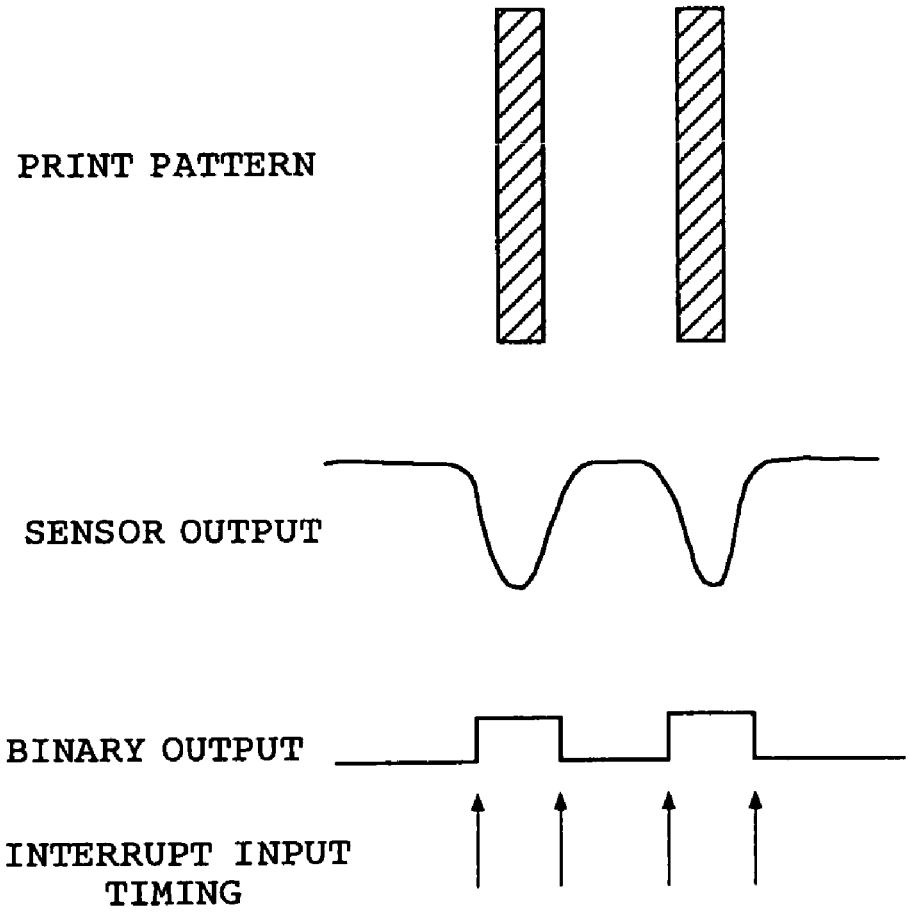
FIG. 6 is a diagram showing a print pattern and the sensor output timing in the embodiment of the present invention.

More specifically, after the horizontal bars HB shown in FIG. 3 are printed, the carriage 106 is moved so that the sensor 110 is positioned in the upstream of the patterns. After that, the print paper 102 is conveyed and, based on the output from the sensor 110, the pattern detector 209 in the print control unit 202 detects a position where the pattern density changes. That is, the analog signal from the sensor 110 is binarized and is sent to the interrupt input terminal of the CPU 203 (FIG. 6). The rising edge and the falling edge of the binary signal correspond to the edges of the above-described pattern element. Each time the rising edge and the falling edge are entered to the interrupt input terminal, the CPU 203 reads the values from the sub-scanning counter 206 and the sub-scanning timer 208 and temporarily stores data in the work memory.

After reading all horizontal bars HB, the vertical bars VB are printed. After printing the vertical bars VB, the print paper 102 is moved so that the sensor 110 is positioned on the vertical bars VB. After that, the carriage 106 scans and, based on the output from the sensor 110, the pattern detector 209 in the print control unit 202 detects a position where the pattern density changes. At the same time, the analog signal from the sensor 110 is binarized and is sent to the interrupt input terminal of the CPU 203. As described above, each time the interrupt terminal receives the rising edge and the falling edge, the CPU 203 reads the values from the main scanning counter 205 and the main scanning timer 207 and temporarily stores data in the work memory. After reading all vertical bars VB, the CPU 203 starts calculating the registration deviation amount.

The order in which the horizontal bars HB and vertical bars VB are processed may be the reverse of the above.

Figure 4:
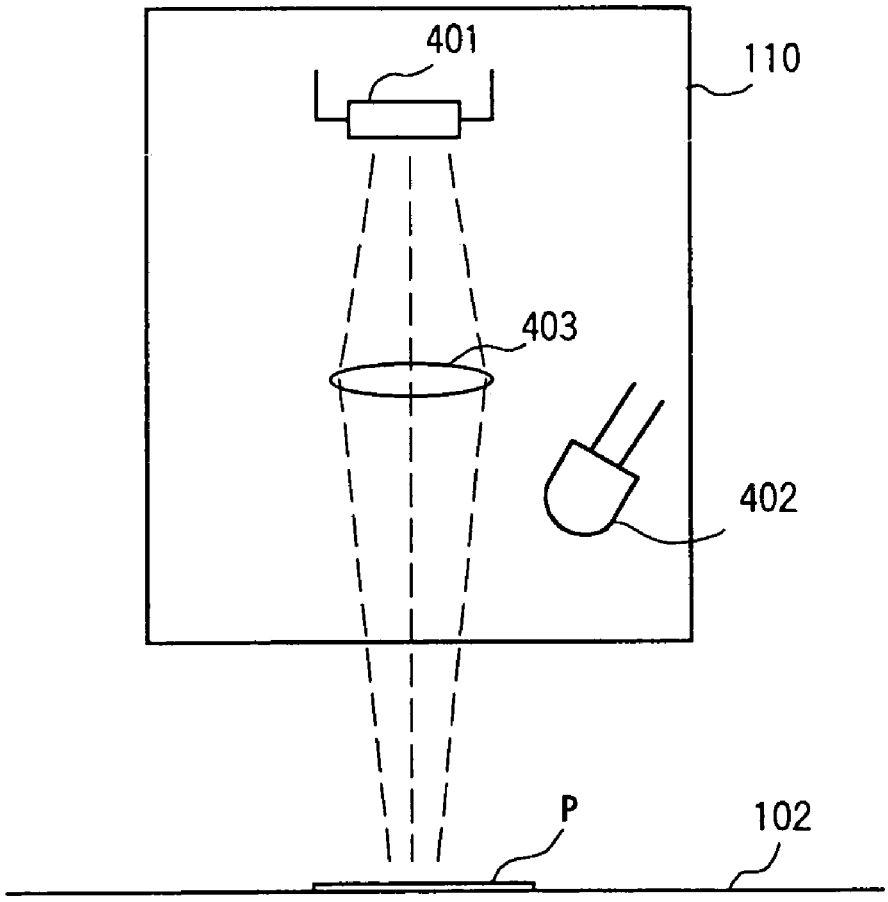
FIG. 4 is a diagram showing the configuration of a sensor used in the embodiment of the present invention.

FIG. 4 is a diagram showing the internal configuration of the sensor 110 used in the image forming device. In the figure, numeral 401 denotes a light-receiving element—either a phototransistor or a photo diode—that has a band (or optical filter) covering the frequency of ink colors. Numeral 402 denotes a light-emitting element for emitting one of R, G, and B that are complementary colors of C, M, and Y. Numeral 403 denotes an optical lens that focuses light, emitted by the light-emitting element 402, on the registration deviation detection pattern P and, with the optical lens, condenses the reflected light on the light receiving element 401 to detect the presence of pattern elements. In this embodiment, the ink colors C, M, Y, and K are used, and the light emitting element that emits R, G, and B independently is used for identifying each ink color and the white of the background paper to allow the emission light to be switched according to the ink color.

Figure 5:
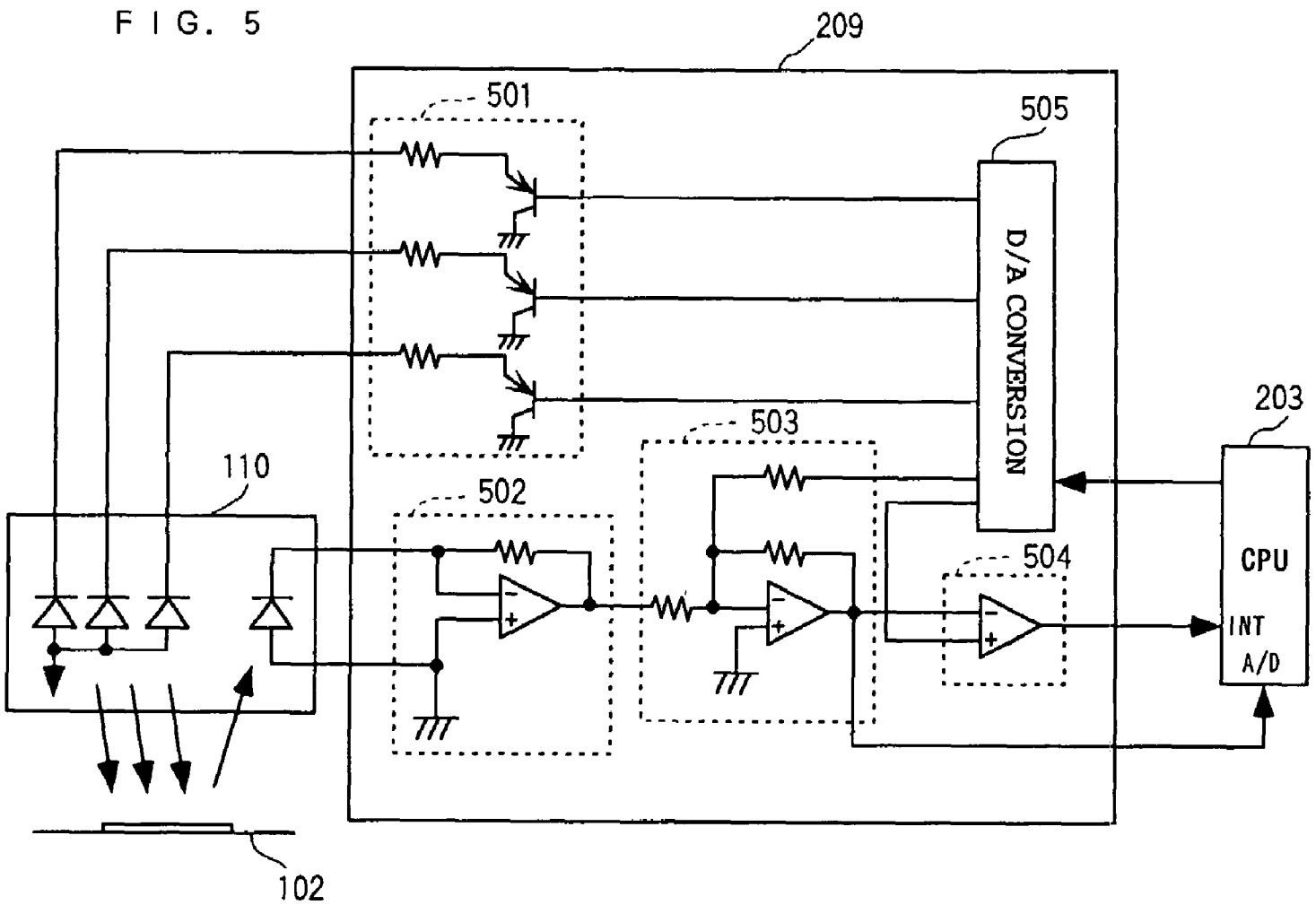
FIG. 5 is a diagram showing the configuration of a pattern detector used in the embodiment of the present invention.

The output from the sensor 110 is used by the pattern detector 209 in the print control unit 202 to detect a change in the density of a pattern. FIG. 5 shows the details of the pattern detector 209.

In FIG. 5, numeral 501 is a light-emitting element driving transistor, numeral 502 is an I-E amplifier that amplifies the current generated in the light-receiving element and converts the current to a voltage, and numeral 503 is an amplifier that further amplifies the output of the I-E amplifier 502. Numeral 504 is a comparator that converts the output of the amplifier 503 to a binary value, and numeral 505 is a D/A converter through which the CPU 203 sets the adjustment values to adjust the light emission amount of the light-emitting element in the sensor 110 and the offset amount of the sensor 110. The output of the amplifier 502 is connected also to the analog-digital conversion input terminal of the CPU 203. To keep the sensor output at a predetermined level before detecting a registration deviation adjustment pattern, the CPU 203 uses this output to adjust the light emission amount of the light emission element in the sensor 110 and the offset of the output from the sensor 110. After adjusting the sensors, the registration deviation adjustment pattern is read to detect the pattern. In addition, the output of the comparator 504 is connected to the interrupt input terminal of the CPU 203. Each time the rising edge or the falling edge of a binary output from the comparator 504 is entered, the CPU 203 reads the values of the main scanning counter 205 and the main scanning timer 207 to detect a horizontal registration deviation, or the values of the sub-scanning counter 206 and the sub-scanning timer 208 to detect a vertical registration deviation, temporarily stores the data in the work memory and, after reading those values, calculates the registration deviation amount.

Figure 7:
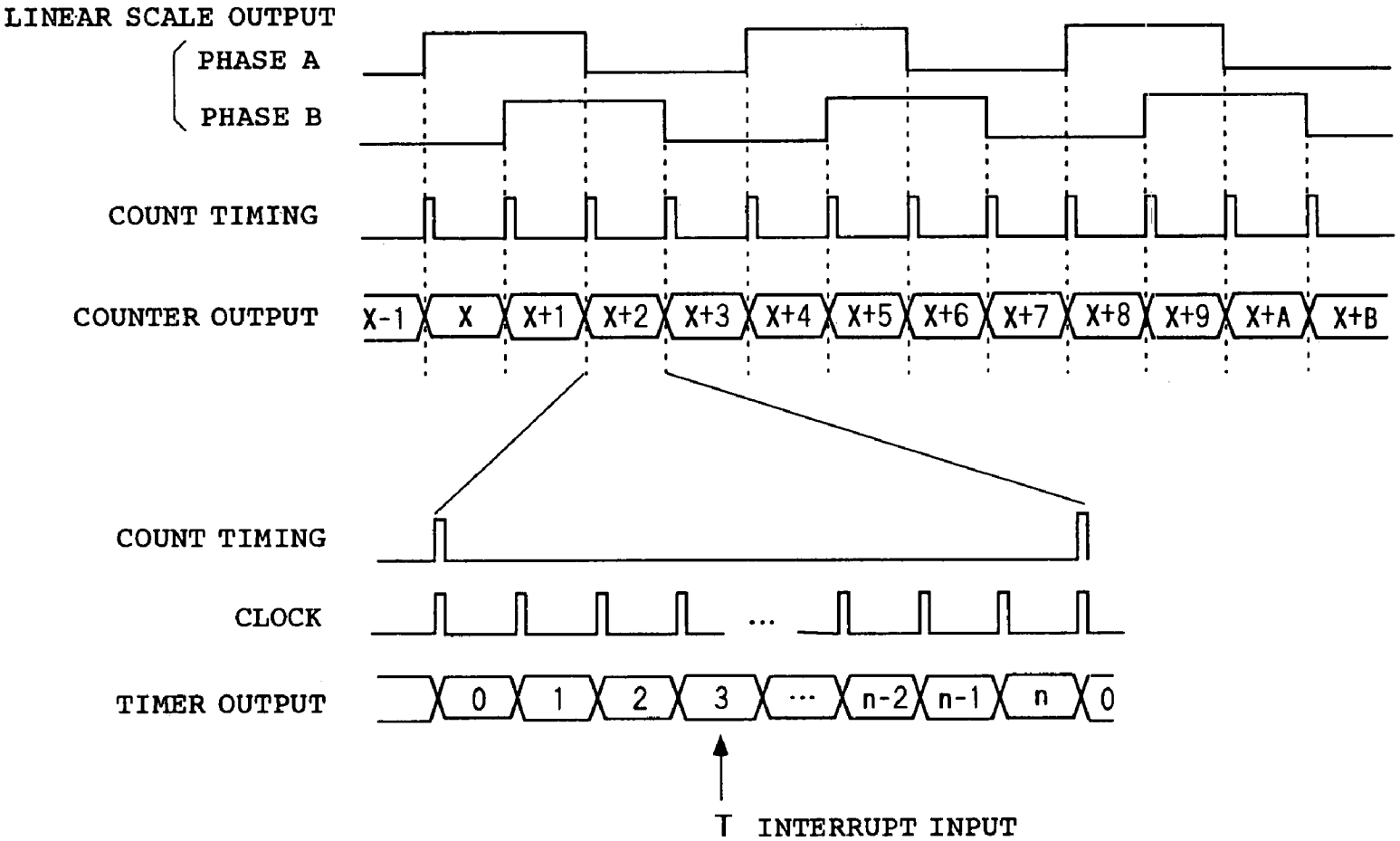
FIG. 7 is a diagram showing the timing in which a linear scale output is obtained when an interrupt is received in the embodiment of the present invention.

FIG. 7 shows the relationship between the interrupt input and the main scanning linear scale when detecting a registration deviation amount in the main scanning direction in this embodiment. As shown in the figure, two phase signals, phase A and phase B, are output from the main scanning linear scale 109 as the carriage 106 moves. The main scanning counter 205 counts the rising and falling edges of phase A/phase B to measure the movement position of the carriage to the extent of the resolution provided with the linear scale 109. Within the time interval between the rising edge and the falling edge of phase A and phase B, the main scanning timer 207 counts shorter-period reference clocks at a predetermined interval to detect the carriage position more finely than it is detected by the main scanning linear scale 109. When an interrupt is sent from the sensor 110 to the CPU 203 at time T while the carriage scan is performed to detect a registration deviation amount, the CPU 203 references the count values of the main scanning counter 205 and the main scanning timer 207 to detect, at a high resolution, the carriage position where the pattern element is detected. To do so, the timer 207 is initialized each time the counting starts. It is desirable that the carriage be driven at a constant speed to minimize the timer measurement error.

If the position of the pattern element was detected only by the main scanning counter 205 that counts the linear scale output, the resolution would depend only on the resolution of the linear scale 109 and, therefore, the registration deviation amount could not be detected precisely. In addition, if the signal was simply sampled in a predetermined timing with the use of the timer as in a conventional device, the mechanical variations would accumulate as described above. Therefore, to detect the position of the pattern element, the device according to the present invention uses the main scanning counter 205 to detect the general absolute position of the pattern and, at the same time, the timer to measure the correct position at a resolution higher than the minimum unit interval of the linear scale. This configuration minimizes the effect of carriage speed variations and, at the same time, detects the position at a higher resolution.

As described above, unlike the device in the prior art that has a configuration in which the timer is used to measure the distance between the pattern elements printed by the base head and the pattern printed by some other head (configuration in which the amount of deviation of the other head with respect to the base head is detected—relative position comparison), the device according to the present invention has a configuration in which the head deviation amount is detected based on the dot position to be printed according to the linear scale and the dot position actually printed (absolute position comparison). This configuration requires only one scanning to detect the center dot position. Therefore, the error is not doubled and the detection error may be minimized.

In addition, although a pair of pattern elements in different colors must always be arranged in parallel for the base head and the comparison head in print pattern for use in relative position comparison, the present invention eliminates this limitation on the print pattern configuration. In addition, when replacing a recording head, the device according to the present invention prints the pattern elements only for the replaced head for detecting the head deviation amount. In relative position comparison, even when only one non-black ink head has been replaced, a pair of black pattern elements and a pair of a black pattern element and a pattern element in the color of the replaced head must be printed. In particular, when replacing the black ink head, the print pattern must be printed for the heads for all ink colors and the deviation amount must be detected for each of the non-black ink heads (Normally, monochrome printing is dominant and, therefore, the black ink head is replaced more frequently than other heads.)

Figure 8:
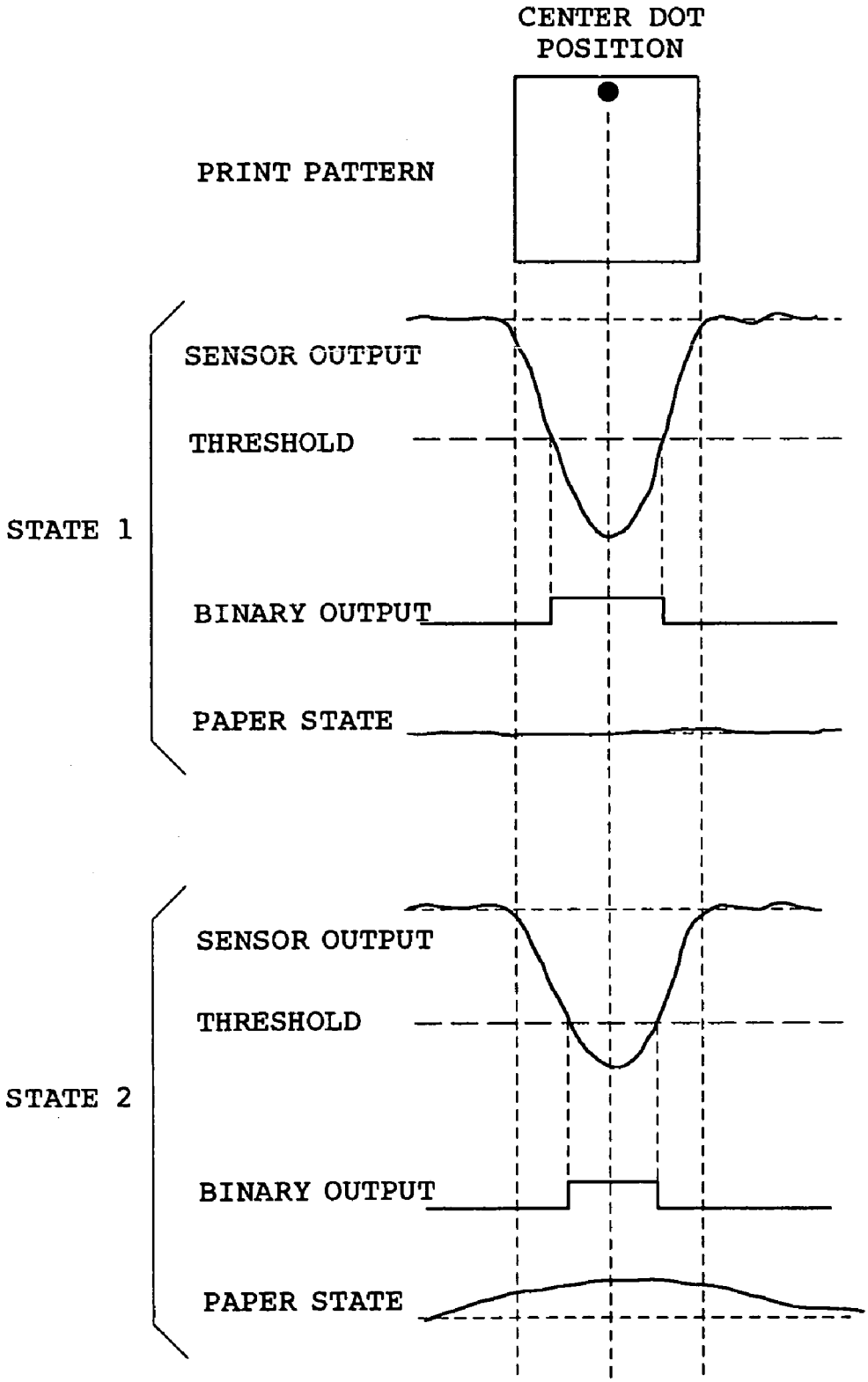
FIG. 8 is a diagram showing how the sensor output changes when a paper floating occurs in the embodiment of the present invention.

After reading the pattern, the CPU 203 reads data from the work memory and, based on the carriage position values for the rising edge and the falling edge, calculates the center dot position of each pattern. As shown in "state 1" and "state 2" in FIG. 8, the sensor output level slightly changes depending upon the paper type, paper floating, sensor accuracy, and light absorption ratio of a color. Therefore, when the comparator 504 binarizes the signal using a fixed threshold, there might be variations in the rising edge positions and falling edge positions in certain cases. To solve this problem, the center position is calculated based on both edge positions. This calculation method always gives a reliable output result because the center position remains unchanged in most cases even when there are variations described above. After that, the difference between the center dot position (indicated value) of each pattern element to be printed and the actual measurement value is calculated. In the example in the above test pattern, the deviation amounts at the center dot positions of a plurality of parallel bars for each color are calculated and then averaged. The registration deviation amount may be calculated from the head position difference obtained in this way.

Figure 9:
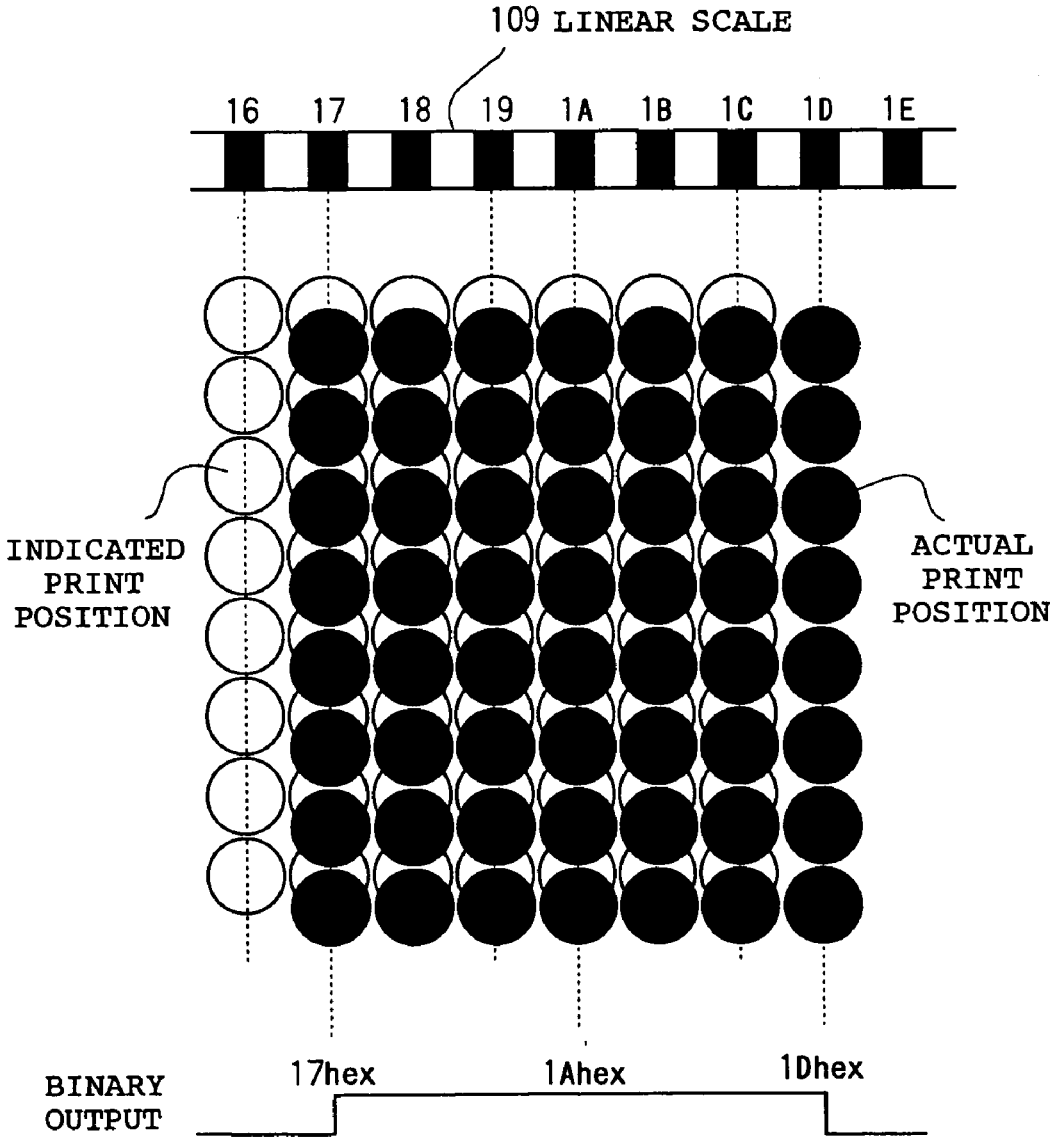
FIG. 9 is a diagram showing an example of print results in the embodiment of the present invention.

An example of a difference in the registration deviation amount will be described with reference to FIG. 9. In the figure, the white circle "○" indicates a dot position at which a dot is to be printed, with the range indicated by the main scanning linear scale count values 16 hex to 1C hex. The black circle "●" indicates that the actual print position has been shifted in the range 17 hex to 1D hex. The center dot position of the pattern element to be printed is 19 hex while the center dot position of the pattern element whose print has been shifted because of a registration deviation is 1A hex. As a result, a one-dot registration deviation is generated. Although a position deviation less than one dot in size may actually occur, a one-dot deviation will be described in the description below for convenience.

Performing the operation described above for the pattern (HB) for detecting a vertical registration deviation and for the pattern (VB) for detecting a horizontal registration deviation detects a vertical/horizontal head mount deviation.

To correct the ink jet positions of each head based on the head registration deviation amount that was detected as described above, the CPU 203 variably changes the address from which, and the timing in which, data is to be read from the image memory in the head control unit 204. In the main scanning direction, the jet positions may be corrected at a resolution more than the resolution (less than the minimum unit interval) of the main scanning linear scale 109. In the sub-scanning direction, the jet position may be corrected on a nozzle basis of the head 101.

Although the correction in the sub-scanning direction may be made only on a nozzle basis in this embodiment, the sub-scanning timer 208 is used to find a registration deviation amount in the sub-scanning direction with a resolution equal to or greater than the resolution of the sub-scanning encoder 210. The reason is that, when a decimal fraction is generated during the detection and calculation of a registration deviation amount in the sub-scanning direction, which nozzle, top or bottom, will minimize the registration deviation amount must be decided. Therefore, the sub-scanning timer 208 in the sub-scanning direction need not be so precise as the timer in the main scanning direction.

In the embodiment described above, a method for detecting a vertical/horizontal registration deviation in a single detection operation has been described. However, a single detection operation sometimes results in the detection result changing each time the deviation is detected because of variations in the sensor output signal level determined by the precision of the sensor 110, variations in linear scales introduced during manufacturing, and variations in the carriage speed. This problem may be solved by increasing the number of detections or patterns and by calculating its average.

Figure 17:
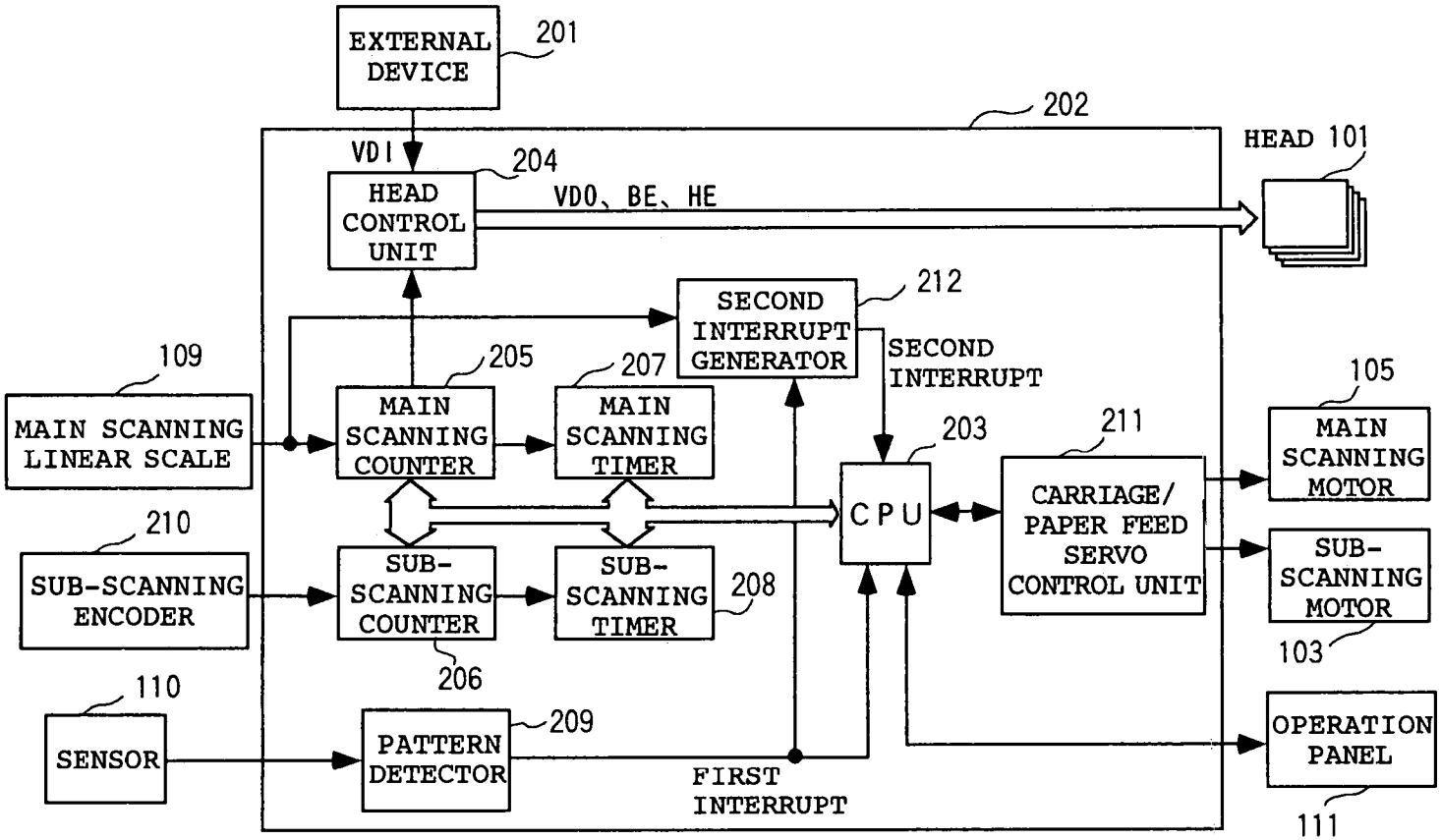
FIG. 17 is a diagram showing a control block in a second embodiment of the present invention.
Figure 18:
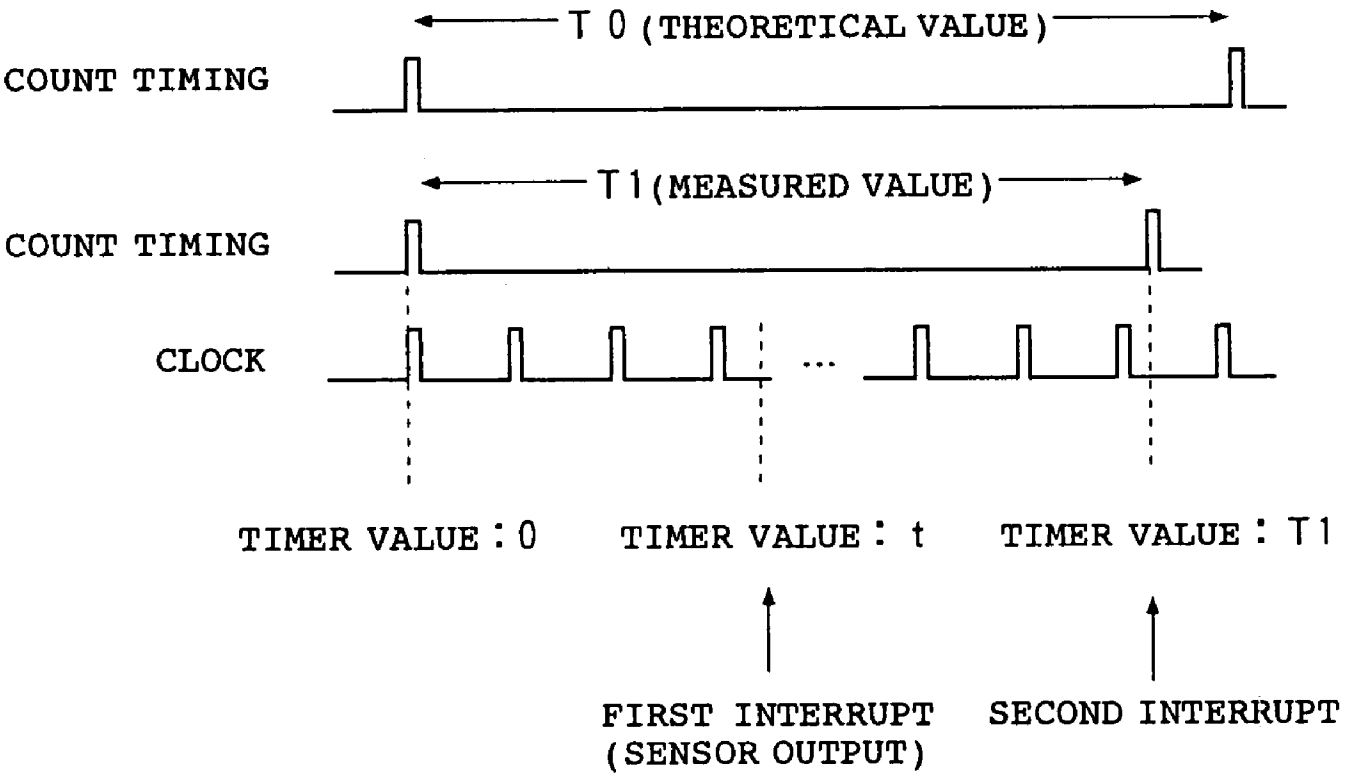
FIG. 18 is a timing chart showing the second embodiment of the present invention.

Next, a second embodiment of the present invention will be described. FIG. 17 shows the configuration of an image forming device in this embodiment. The configuration in this figure is almost similar to that shown in FIG. 2 except that a second interrupt generator 212 is added. As shown in the timing chart in FIG. 18, the second interrupt generator 212 sends the second interrupt signal to the CPU 203 when the timing signal is issued from the main scanning linear scale 109 immediately after the pattern detector 209 sends the interrupt signal (first interrupt) to the CPU 203. This second interrupt allows the CPU 203 to know the timer value T1 of the main scanning timer 207 at that moment. In this embodiment, the timer value in the main scanning timer 207 is reset immediately after the timer value T1 is identified. The measured timer value T1 may be different from the theoretical value T0, calculated from the predetermined speed, depending upon the variation in the carriage speed. The figure shows a case in which the actual carriage speed is slightly higher than the predetermined speed. Therefore, the timer value t measured based on the first interrupt, which is affected by the variation in the speed, is thought to be different from the theoretical value (in this example, the value is smaller). To correct the value affected by the variation in the speed, the timer correction value tc (theoretical value) is calculated by the following formula:

$$tc=(t/T1)\times T0$$

This adjustment also makes it possible to eliminate the effect of variation in the carriage speed within the minimum unit interval determined according to the linear scale resolution for the position where the pattern element is detected.

Next, a third embodiment of the present invention will be described. The configuration of an image forming device in this embodiment is similar to that shown in FIGS. 1 and 2 except the internal configuration and operation of the head control unit 204.

Figure 19:
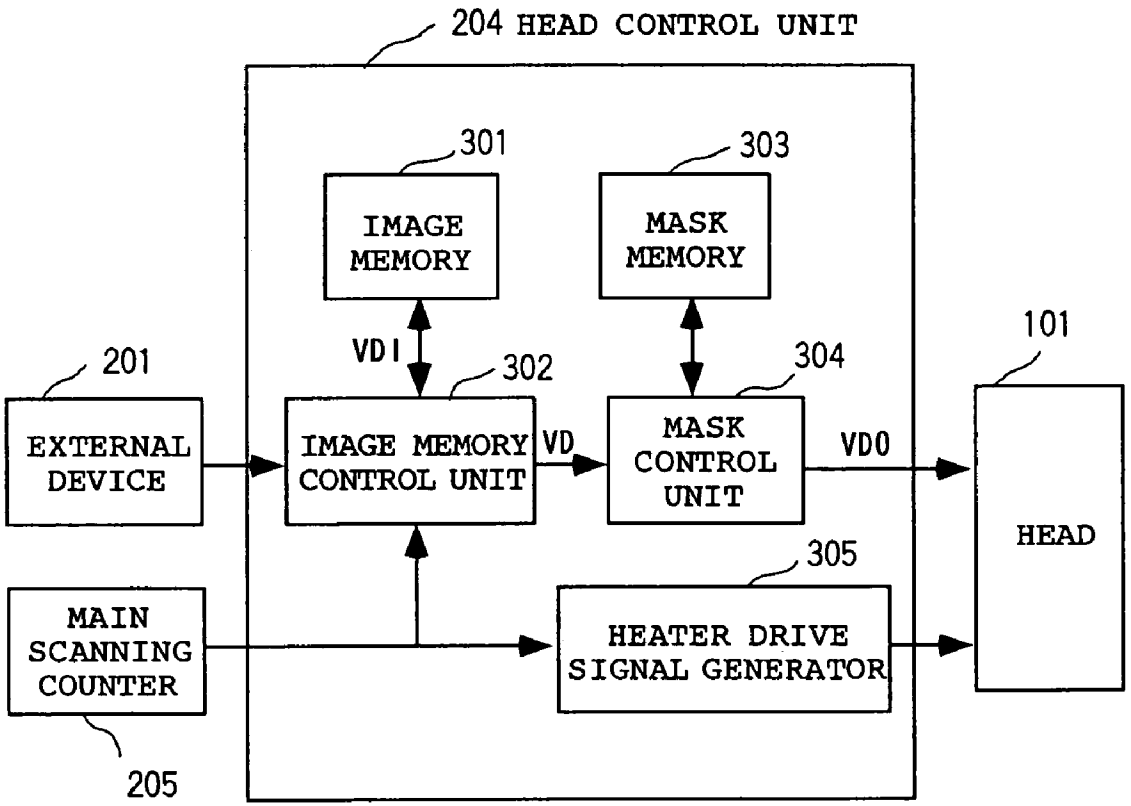
FIG. 19 is a diagram showing the internal block of a head control unit in a third embodiment of the present invention.

FIG. 19 shows an example of the internal configuration of the head control unit 204. The head control unit 204 generally comprises an image memory 301, an image memory control unit 302, a mask memory 303, a mask control unit 304, and a heater drive signal generator 305.

The image memory control unit 302 performs memory control as follows. That is, it temporarily stores into the image memory 301 several bands of serial image data VDI transferred from the external device 201 as described above and, as the head 101 scans, it outputs the stored image data to the head 101 as the image data VDO. When storing the image data VDI into the image memory 301, the unit generates the memory address signal in synchronization with the timing in which data is transferred from the external device 201 and sequentially stores the image data VD. When outputting the image data from the memory as the head 101 scans, the unit generates the memory address signal in synchronization with the synchronizing signal output from the main scanning counter 205 that counts the output from the main scanning linear scale 109 and outputs the image data VD from the memory.

The mask control unit 304 thins out a predetermined amount of data from the image data to smooth an image density unevenness generated by the variations in the nozzle shape and direction introduced during recording head manufacturing so that the control unit causes the same band to be scanned several times to print an image with the 100% of duty (This print method is generally called multi-pass recording).

Figure 20A:
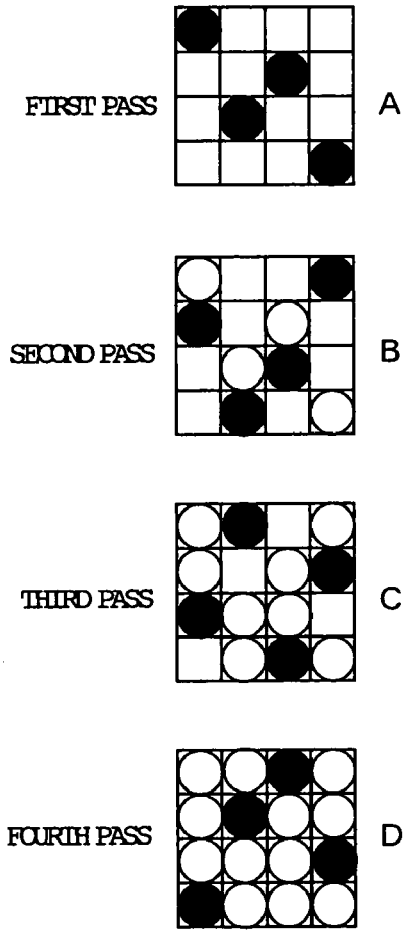
FIGS. 20(*a*) and 20(*b*) are diagrams showing how multi-pass printing is performed in the embodiment shown in FIG. 19.
Figure 20B:
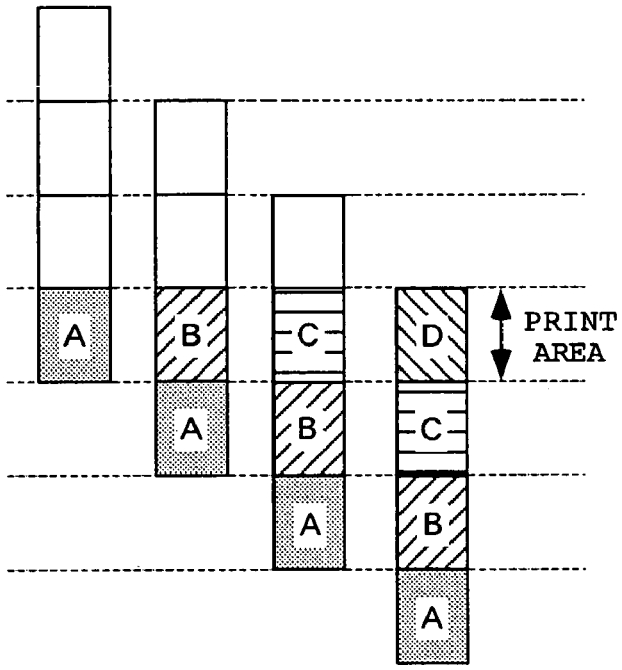

An example of multi-pass recording will be described with reference to FIGS. 20(*a*) and 20(*b*), in which, for simplicity, a single ink color head composed of 16 nozzles is shown. In the first scan, the dots of pattern A are recorded. "●" indicates a dot that is recorded in this scan. Then, after the paper is fed ¼ (four dots wide) of the head recording width (band) in the paper conveyance direction, the dots "●" of pattern B are recorded in the second scan. In the figure, "○" indicates a dot that has already been recorded. In the third scan, the dots "Åú "●" of pattern C are recorded and, finally, the dots "○" of pattern D are recorded in the fourth scan. This sequential processing completes recording. That is, by feeding paper four dots at a time and sequentially recording patterns A–D, a four-dot recording area is completed in each of four scans. This recording method differs from one-time scan (single-pass) recording method in that a four-dot recording area is sequentially recorded using four nozzles, at a time, that are in different portions of a head. This method ensures a high-quality image with little or no unevenness. The multi-pass recording method also has an advantage that an image is recorded while drying it.

There are several methods for generating pass data for each scan. For example, pass data is generated by using a fixed mask pattern to thin out recording data as described above (called fixed thinning-out), by using a random mask pattern where recording dots and non-recording dots are randomly arranged to thin out recording data (called random thinning-out), or by thinning out recording dots according to the data (called data thinning-out).

To achieve multi-pass recording described above, the mask control unit 304 thins out a predetermined amount of data from image data VD output from the image memory control unit 302. A mask pattern is written in the mask memory 303 by the CPU before data is printed, and is read from the mask memory 303 in synchronization with the image data VD output from the image memory control unit 302 when the data is printed. Only the data corresponding to a portion where both the mask pattern and the print data are ON is output to the head 101 as the output data VDO.

As described above, the heater drive signal generator 305 generates the signal that selects which block in the head to drive (block enable signal (BE0–3)) and the heater drive pulse signal HE in synchronization with the synchronizing signal output from the main scanning counter 205 that counts the output of the main scanning linear scale 109. From the head 101, ink is jetted from only the nozzles where the block enable signal BE0–3, the heater drive pulse signal HE, and the image data VDO are all enabled.

Figure 21:
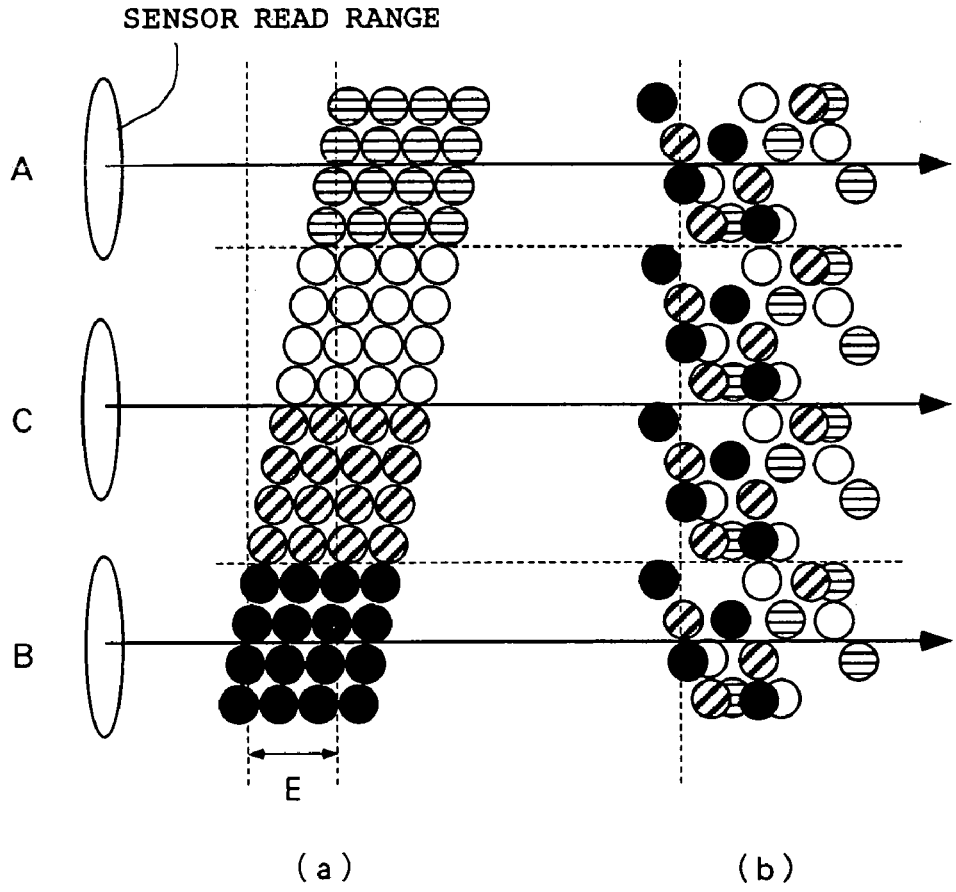
FIGS. 21(*a*) and 21(*b*) are diagrams showing the difference in print results between single-pass printing and multi-pass printing in the embodiment shown in FIG. 19.

Although the test pattern used in the third embodiment looks externally the same as that shown in FIG. 3, the vertical bar VB is printed in multiple passes in the multi-pass recording method described above. FIG. 21(*b*) shows the print result. FIG. 21(*a*) shows the print result produced by printing the vertical bar pattern in a single pass (the pattern is formed in the single pass of the carriage with no data thinned out with the use of a mask), as in the conventional method, using a head mounted with skew on the carriage. In this case, the print result directly reflects the head skew. On the other hand, FIG. 21(*b*) shows the result produced by printing the vertical bar in four passes according to the mask method described above. Although the print result in FIG. 21(*b*) may look more uneven, the uneven printing in the print result in FIG. 21(*b*) can be averaged more easily, considering the variation in the shape or direction of the nozzles produced during recording head manufacturing. (To illustrate the edge errors of pattern elements for detecting a registration deviation amount, the figure shows only a print result produced when the head is mounted with skew). When the read range of the sensor in the sub-scanning direction is four dots, a serious error would be generated in FIG. 21(*a*) in the bar edge detection positions if the positions at which the pattern is read differ largely in the longitudinal direction of the bar. For example, there is an error E between position A and position B. On the other hand, in multi-pass printing in FIG. 21(*b*), such an error is not generated or extremely slight if generated.

Figure 22:
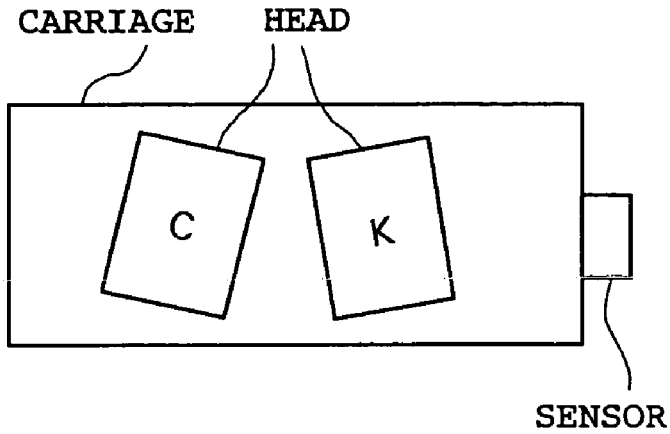
FIGS. 22(*a*), 22(*b*), and 22(*c*) are diagrams showing a head that is inclined and print results in the embodiment show in FIG. 19.
Figure 22:
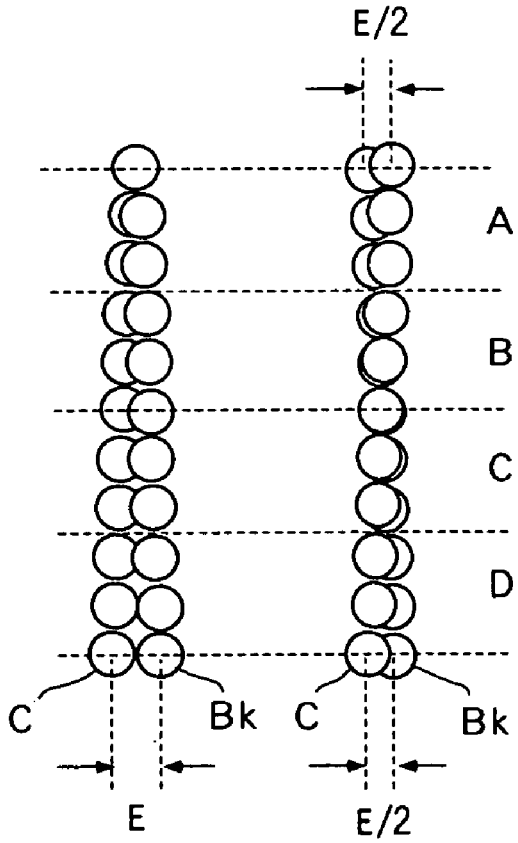
Figure 23:
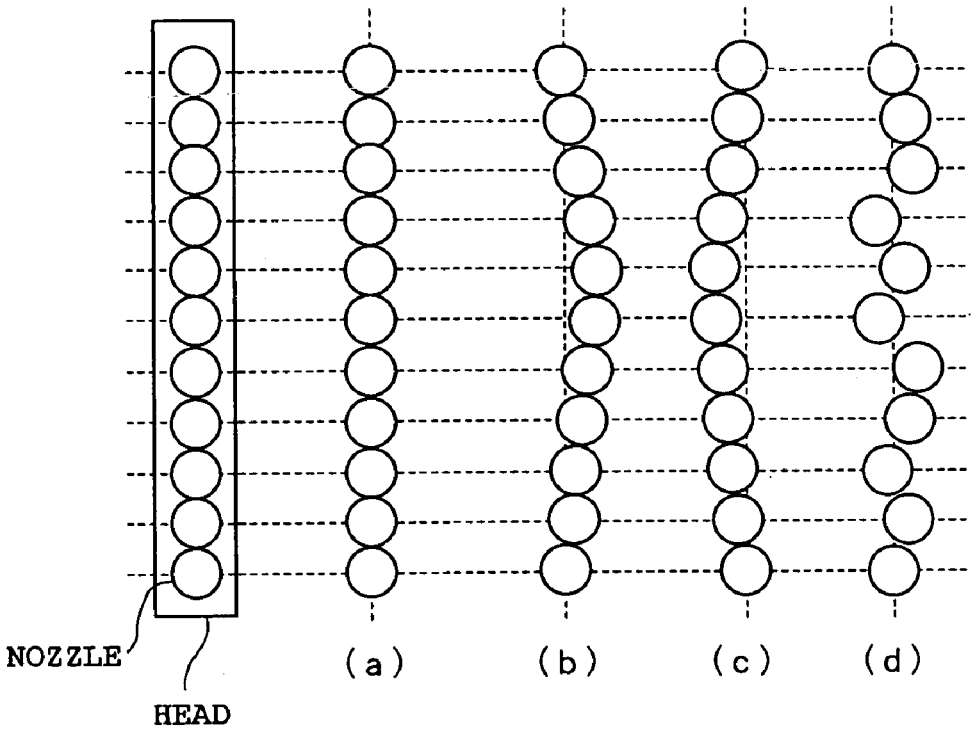
FIG. 23 is a diagram showing how head manufacturing variations affect the jet of ink.
Figure 24:
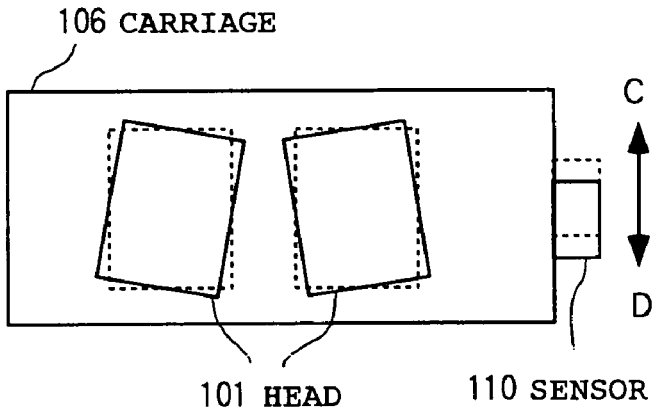
FIG. 24 is a diagram showing variations in the mounting of a head on a carriage.
Figure 25:
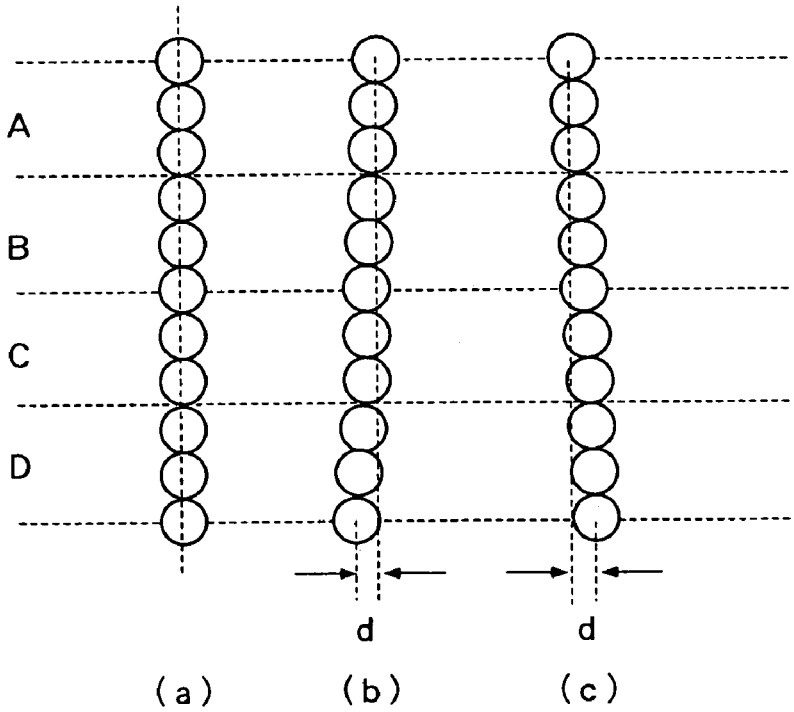
FIGS. 25(*a*), 25(*b*), and 25(*c*) are diagrams showing how variations in the mounting of a head on a carriage affect the jet of ink.

For example, as shown in FIG. 22(*a*), consider that head C is inclined toward the right and head K is inclined toward the left and that the sensor is installed on the carriage such that the sensor senses the bottom area of the pattern. If a registration deviation is detected and corrected in this situation in the conventional method, the corrected result is as shown in FIG. 22(*b*) in which dots in the top of the pattern overlap each other and the error E is generated in the bottom of the pattern. On the other hand, if the pattern elements of the vertical bar are printed in multiple passes by the device according to the present invention, the corrected result is as shown in FIG. 22(*c*) in which the patterns overlap at the center and the maximum error of up to E/2 is detected at the top and the bottom. The more passes of multi-pass printing, the better the result.

It is desirable that the vertical bar VB be scanned repeatedly at two or more positions as in positions A, B, and C in FIG. 21 (three positions in this embodiment) and that the values that have been read be averaged. The reason is as follows. Even when printing in multiple passes, a slight error is generated in the read positions because of the vertical direction variations or twists in the nozzles or an error in the paper feed amount. To further smooth the errors, multiple read operations may be performed while changing the read position in the longitudinal direction of the bar, to minimize the error.

While preferred embodiments of the present invention have been described, such description is illustrative purposes only and not restrictive, and it is to be understood that changes and variations may be made without departing from the scope of the claims of the present invention.

INDUSTRIAL APPLICABILITY

The present invention provides an image forming device capable of precisely detecting a head deviation when the head has been replaced. The device minimizes a detection error that may be generated because of variation in the movement speed of the carriage or a print paper, allowing a head registration deviation to be detected precisely. Because a pattern may be detected in a single scan of a test pattern in principle, the time to detect an error in the head mounting position may be reduced.

In addition, a vertical bar pattern is printed in multiple passes, the pattern is detected repeatedly in two or more positions, and the detection results are averaged to calculate a registration deviation amount. This method further reduces the effect of variation in the shape and direction of nozzles introduced during head manufacturing, head mounting skews, and variation in the installation of the sensor on the carriage.

What is claimed is:

1. An image forming device that forms an image on a print paper in an ink jet recording method with at least one head, comprising:

main scanning direction moving means for moving a carriage in a main scanning direction, said carriage having said at least one head mounted thereon;

paper conveying means for conveying the print paper in a sub-scanning direction;

pattern printing means for printing, with said at least one head, a test pattern including predetermined pattern elements;

pattern detecting means, mounted on said carriage, for detecting the pattern elements of the test pattern printed on the print paper by said printing means;

binary conversion means for binarizing an output of said pattern detecting means;

position detecting means for detecting a position of the carriage in said main scanning direction; and calculating means for moving said carriage to detect the pattern elements of the test pattern with said pattern detecting means, for detecting a print position of the pattern elements based on a detection result of said position detecting means when a rising and/or falling edge of a binary signal obtained by said binary conversion means is generated, and for calculating a mounting deviation amount of each head in said main scanning direction, wherein said position detecting means comprises low-resolution position detecting means based on a linear scale provided on a movement path of said carriage and high-resolution position detecting means for detecting a position more than twice as finely as a minimum unit determined by a resolution of said low-resolution position detecting means, wherein said low-resolution position detecting means comprises a counter for counting a timing signal based on said linear scale to determine a low-resolution position of said carriage at a time when said a rising and/or falling edge of a binary signal obtained by said binary conversion means is detected, and wherein said high-resolution position detecting means comprises a timer which is initialized by said timing signal and measures a time with a predetermined clock signal to determine a high-resolution position of said carriage within a unit interval determined by a resolution of said linear scale at a time when said a rising and/or falling edge of a binary signal obtained by said binary conversion means is detected, and wherein a count value of said counter and a measured value of said timer are combined with each other to precisely define the position of the pattern element detected by said pattern detecting means, and said position of the pattern element is compared with a print target position of said pattern element to obtain a mounting deviation amount of the head that printed said pattern element.

2. The image forming device according to claim 1 wherein, for each head, said test pattern is at least one vertical bar extending in the sub-scanning direction substantially perpendicular to said main scanning direction.

3. The image forming device according to claim 2 wherein said pattern detecting means is a reflective sensor comprising a light emitting element and a light receiving element.

4. The image forming device according to claim 1, wherein said test pattern includes, for each head and as a pattern element, at least one horizontal bar extending substantially in parallel with said main scanning direction, further comprising:

conveyance amount detecting means for detecting a conveyance amount of the print paper in the sub-scanning direction substantially perpendicular to said main scanning direction; and measuring means for measuring the conveyance amount equal to or smaller than a minimum unit determined by a resolution of said conveyance amount detecting means, wherein said calculating means moves the print paper, on which the test pattern is printed, with the use of said paper conveying means with respect to the carriage to detect the pattern elements of the test pattern with said pattern detecting means, detects the print position of the pattern elements based on the detection results of said conveyance amount detecting means and said measuring means when a rising and/or falling edge of the binary signal obtained by said binary conversion means is generated, and calculates an amount of mounting deviation of each head in said sub-scanning direction based on the print position of the pattern elements printed by each head.

5. The image forming device according to claim 4 wherein said pattern detecting means is a reflective sensor comprising a light emitting element and a light receiving element.

6. The image forming device according to claim 1 wherein said pattern detecting means is a reflective sensor comprising a light emitting element and a light receiving element.

7. The image forming device according to claim 1 wherein said calculating means uses said pattern detecting means to detect the vertical bar in at least two positions in a longitudinal direction of said vertical bar to obtain a print position of said vertical bar based on an average value of the detected results.

8. The image forming device according to claim 1, further comprising:

means for measuring a unit time interval of said linear scale at a time said pattern elements are detected; and means for correcting a measured value of said timer based on the measured value and a theoretical value of said unit time interval.

9. The image forming device according to claim 1 wherein, based on both edges of an obtained pattern element, said calculating means calculates a center position of a width of the pattern element.

10. An image forming device that forms an image on a print paper in an ink jet recording method with a plurality of heads, comprising:

main scanning direction moving means for moving a carriage in a main scanning direction, said carriage having said plurality of heads mounted thereon;

paper conveying means for conveying the print paper in a sub-scanning direction;

pattern printing means for printing, with at least one head, a test pattern including predetermined pattern elements;

pattern detecting means, mounted on said carriage, for detecting the pattern elements, of the test pattern printed on the print paper by said printing means;

binary conversion means for binarizing an output of said pattern detecting means;

position detecting means for detecting a position of the carriage in said main scanning direction; and calculating means for moving said carriage to detect the pattern elements of the test pattern with said pattern detecting means, for detecting a print position of the pattern elements based on a detection result of said position detecting means when a rising and/or falling edge of a binary signal obtained by said binary conversion means is generated, and for calculating a mounting deviation amount of each head in said main scanning direction, wherein said position detecting means comprises low-resolution position detecting means based on a linear scale provided on a movement path of said carriage and high-resolution position detecting means for detecting a position more finely than a minimum unit determined by a resolution of said low-resolution position detecting means such that said low-resolution position detecting means and said high-resolution position detection means are combined with each other to precisely detect the positions of the pattern elements, wherein, for each head, said test pattern is at least one vertical bar extending in the sub-scanning direction substantially perpendicular to said main scanning direction, and wherein said pattern printing means causes each of different portions of a single head to print a plurality of dots sequentially in a plurality of passes, said plurality of dots constituting a portion of said vertical bar.

11. The image forming device according to claim 10 wherein said calculating means uses said pattern detecting means to detect the vertical bar in at least two positions in a longitudinal direction of said vertical bar to obtain a print position of said vertical bar based on an average value of the detected results.

12. An image forming device that forms an image on a print paper in an ink jet recording method with a plurality of heads, comprising:

main scanning direction moving means for moving a carriage in a main scanning direction, said carriage having said plurality of heads mounted thereon;

paper conveying means for conveying the print paper in a sub-scanning direction;

pattern printing means for printing, with at least one head, a test pattern including predetermined pattern elements;

pattern detecting means, mounted on said carriage, for detecting the pattern elements of the test pattern printed on the print paper by said printing means;

binary conversion means for binarizing an output of said pattern detecting means;

position detecting means for detecting a position of the carriage in said main scanning direction; and calculating means for moving said carriage to detect the pattern elements of the test pattern with said pattern detecting means, for detecting a print position of the pattern elements based on a detection result of said position detecting means when a rising and/or falling edge of a binary signal obtained by said binary conversion means is generated, and for calculating a mounting deviation amount of each head in said main scanning direction, wherein, for each head, said test pattern includes as a pattern element at least one vertical bar extending in the sub-scanning direction substantially perpendicular to said main scanning direction, and wherein said pattern printing means divides said vertical bar into a plurality of portions and causes each of different portions of a single head to print a plurality of dots sequentially in a plurality of passes, said plurality of dots constituting a portion of said vertical bar.

13. The image forming device according to claim 12 wherein, based on both edges of an obtained pattern element, said calculating means calculates a center position of a width of the pattern element.

14. A method, for use on an image forming device with a linear scale provided on a carriage movement path, for detecting a deviation between a print position actually printed on a print paper by a head and a print target position, said method comprising the steps of:

providing a timer for detecting a position within a unit interval determined by a resolution of said linear scale;

printing a predetermined print element at the target position on the print paper by the head mounted on a carriage that scans in a main scanning direction;

detecting said print element with a sensor mounted on said carriage while moving said carriage in a main scanning direction;

detecting a low-resolution position of said carriage based on said linear scale so as to determine a low-resolution position of said carriage at a time when the print element is detected by said sensor;

detecting a high-resolution position within the unit interval so as to determine a position of said carriage by combining said low-resolution position with a measured value of said timer at a time when the print element is detected by said sensor; and obtaining the deviation between said high-resolution position and said print target position.

15. The method according to claim 14, further comprising the step of correcting the high-resolution position within the unit interval, which was detected by said timer, based on an actual measurement value measured in a minimum unit interval of said linear scale and a theoretical value thereof.

16. A method for printing a test pattern including a predetermined pattern element on a print paper in an ink jet recording method with a head which includes vertically aligned recording elements, said predetermined pattern element having at least one vertical bar extending in a sub-scanning direction substantially perpendicular to a main scanning direction of said head, the method comprising the steps of:

dividing said vertical bar to be printed into a plurality of vertically aligned portions, each portion being divided into N groups of dots;

dividing said vertically aligned recording elements of said head into N vertically aligned groups;

causing n-th group of said recording elements of said head to print n-th group of dots in each portion of said vertical bar.

17. An image forming device that forms an image on a print paper in an ink jet recording method with at least one head, comprising:

main scanning direction moving means for moving a carriage in a main scanning direction, said carriage having said at least one head mounted thereon;

paper conveying means for conveying the print paper in a sub-scanning direction;

pattern printing means for printing, with said at least one head, a test pattern including predetermined pattern elements;

pattern detecting means, mounted on said carriage, for detecting the pattern elements of the test pattern printed on the print paper by said printing means;

binary conversion means for binarizing an output of said pattern detecting means;

position detecting means for detecting a position of the carriage in said main scanning direction; and means for moving said carriage to detect the pattern elements of the test pattern with said pattern detecting means, for detecting a print position of the pattern elements based on a detection result of said position detecting means when a rising and/or falling edge of a binary signal obtained by said binary conversion means is generated, wherein said position detecting means comprises low-resolution position detecting means based on a linear scale provided on a movement path of said carriage and high-resolution position detecting means for detecting a position more than twice as finely as a minimum unit determined by a resolution of said low-resolution position detecting means, wherein said low-resolution position detecting means comprises a counter for counting a timing signal based on said linear scale to determine a low-resolution position of said carriage at a time when said a rising and/or falling edge of a binary signal obtained by said binary conversion means is detected, and wherein said high-resolution position detecting means comprises a timer which is initialized by said timing signal and measures a time with a predetermined clock signal to determine a high-resolution position of said carriage within a unit interval determined by a resolution of said linear scale at a time when said a rising and/or falling edge of a binary signal obtained by said binary conversion means is detected, and wherein a count value of said counter and a measured value of said timer are combined with each other to precisely define the position of the pattern element detected by said pattern detecting means.

* * * * *